US012747049B2

(12) United States Patent
Hensel et al.

(10) Patent No.: US 12,747,049 B2
(45) Date of Patent: Sep. 29, 2026

(54) METHOD AND TOOL FOR PRODUCING STRAPPED PACKAGES

(71) Applicant: Krones Aktiengesellschaft, Neutraubling (DE)

(72) Inventors: Thomas Hensel, Aying (DE); Marcus Kreis, Kolbermoor (DE); Florian Saumweber, Rosenheim (DE); Herbert Spindler, Niedermoosen (DE); Thomas Stadler, Kolbermoor (DE)

(73) Assignee: Krones Aktiengesellschaft, Neutraubling (DE)

( * ) Notice: Subject to any disclaimer, the term of this patent is extended or adjusted under 35 U.S.C. 154(b) by 271 days.

(21) Appl. No.: 18/570,238

(22) PCT Filed: Apr. 26, 2022

(86) PCT No.: PCT/EP2022/061017
§ 371 (c)(1),
(2) Date: Dec. 14, 2023

(87) PCT Pub. No.: WO2022/268379
PCT Pub. Date: Dec. 29, 2022

(65) Prior Publication Data

US 2024/0286780 A1 Aug. 29, 2024

(30) Foreign Application Priority Data

Jun. 24, 2021 (DE) ..... 10 2021 116 337.4

(51) Int. Cl.
*B65B 13/00* (2006.01)
*B65B 13/02* (2006.01)
(Continued)

(52) U.S. Cl.
CPC ..... *B65B 13/02* (2013.01); *B65B 13/20* (2013.01); *B65B 27/04* (2013.01)

(58) Field of Classification Search
CPC ..... B65B 27/04; B65B 13/02; B65B 13/20; B65B 13/022; B65B 61/14; B65B 17/02;
(Continued)

(56) References Cited

U.S. PATENT DOCUMENTS 3,950,203 A * 4/1976 Van der Wal ..... B65B 13/02 53/586
5,775,486 A 7/1998 Edqvist
(Continued)

FOREIGN PATENT DOCUMENTS

DE 202006000215 U1 3/2006
DE 202020101850 U1 5/2020
(Continued)

OTHER PUBLICATIONS

PCT Application: PCT/EP2022/061017 Filed Apr. 26, 2022—International Preliminary Report on Patentability dated Jan. 4, 2024.
(Continued)

*Primary Examiner* — Jacob A Smith
(74) *Attorney, Agent, or Firm* — Simmons Perrine PLC

(57) ABSTRACT

The invention relates to a method and a tool for producing strapped packages, where least two articles having deformable or flexible lateral surfaces are grouped and brought into a rectangular arrangement and kept together by at least one strapping band. In the method, firstly deformation forces are applied to at least one short side of the group of articles, which deformation forces act approximately uniformly on all articles of the group. Subsequently, the strapping band (26) is placed on the group of articles, wherein an overall length of the strapping band corresponds to or is minimally greater than an overall circumference of the group. The deformation forces acting on the group are then removed, wherein the lateral surfaces of the articles elastically return to their original shape and bring about a band tensioning of
(Continued)

the strapping band. The invention also relates to a tool for carrying out the method.

19 Claims, 14 Drawing Sheets

(51) Int. Cl.
*B65B 13/20* (2006.01)
*B65B 27/04* (2006.01)

(58) Field of Classification Search
CPC ..... B65B 21/00; B65B 13/185; B65B 13/24; B65B 13/32
USPC ..... 53/139.4, 391, 399, 413, 414
See application file for complete search history.

(56) References Cited

U.S. PATENT DOCUMENTS

| | | | | |
|---|---|---|---|---|
| 6,041,572 | A | 3/2000 | Gandini | |
| 7,377,213 | B1 * | 5/2008 | Haberstroh | B65B 13/22 100/32 |
| 7,428,865 | B1 * | 9/2008 | Kasel | B65B 27/10 53/529 |
| 9,284,105 | B2 | 3/2016 | Ghezzi | |
| 11,945,613 | B2 | 4/2024 | Sauerwein et al. | |
| 12,311,630 | B2 | 5/2025 | Price | |
| 2002/0116900 | A1 * | 8/2002 | Cranston, III | B65B 13/32 53/399 |
| 2014/0075885 | A1 | 3/2014 | Perl | |
| 2018/0022489 | A1 * | 1/2018 | Tanner | B41J 2/32 53/399 |
| 2019/0352085 | A1 * | 11/2019 | Bright | B65B 13/20 |

FOREIGN PATENT DOCUMENTS

| | | | |
|---|---|---|---|
| DE | 102019116128 | A1 | 12/2020 |
| DE | 102019123830 | A1 | 3/2021 |
| FR | 1130441 | A | 2/1957 |
| GB | 900833 | A | 7/1962 |
| WO | 8805016 | A1 | 7/1988 |

OTHER PUBLICATIONS

PCT Application: PCT/EP2022/061017 Filed Apr. 26, 2022—International Search Report and Written Opinion dated Nov. 22, 2022.
PCT Application: PCT/EP2022/061017 Filed Apr. 26, 2022—Partial Search Report dated Sep. 5, 2022.
Priority Application: DE 10 2021 116 337.4 Filed Jun. 24, 2021—German Search Report Dated Sep. 5, 2022.
First Chinese Office Action dated Mar. 10, 2026.
Mexican Office Action dated Apr. 6, 2026.

* cited by examiner

Fig. 1A
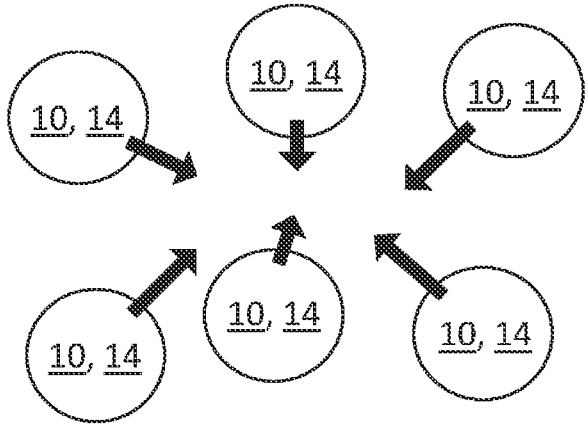
Fig. 1B
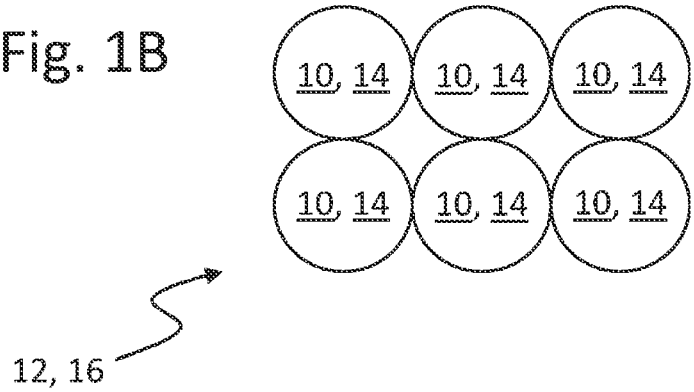
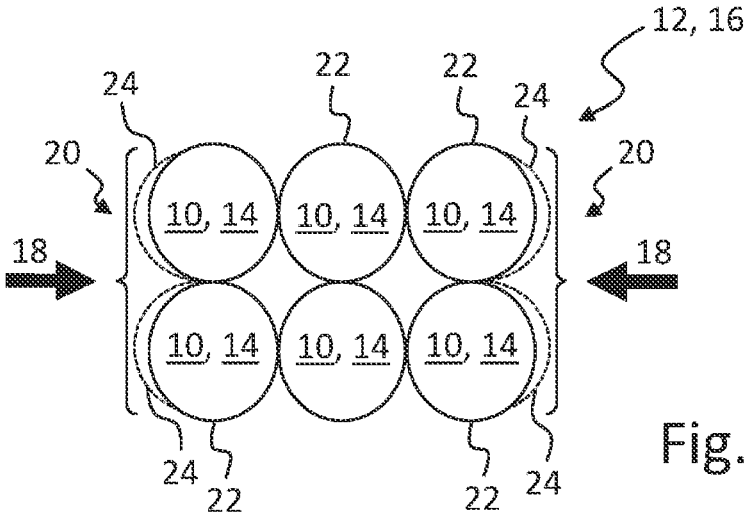
Fig. 1C

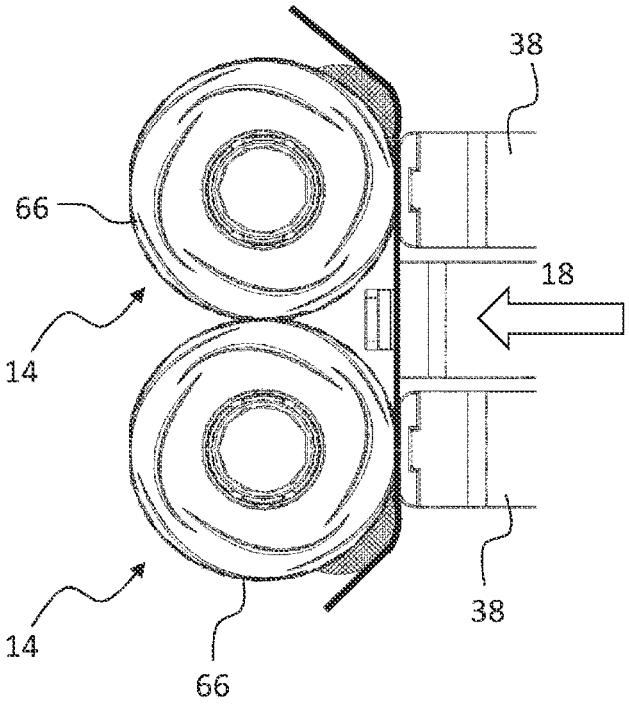
Fig. 6B
Fig. 6C
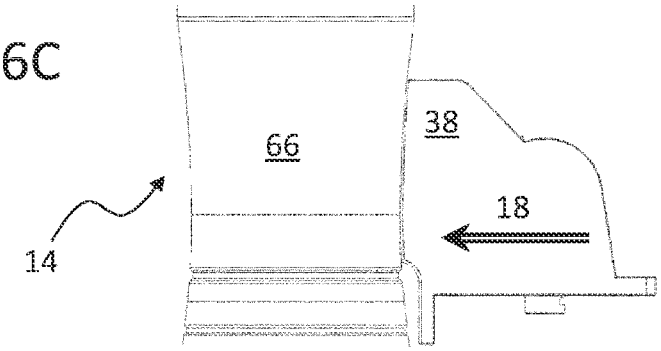

METHOD AND TOOL FOR PRODUCING STRAPPED PACKAGES

CLAIM OF PRIORITY

The present application claims priority to International Application PCT/EP2022/061017 dated Apr. 26, 2022, which in turn claims priority to German Application DE 10 2021 116 337.4 dated Jun. 24, 2021, which are incorporated by reference.

FIELD OF THE INVENTION

The present invention relates to a method for producing strapped packages and to a tool for producing strapped packages.

BACKGROUND OF THE INVENTION

For the purpose of transport, groups of similar articles, such as beverage containers, are often kept together in handy packages, it being possible for these packages to comprise, for example, three, four, six or more articles or containers held together. In the case of such packages, the articles or containers can optionally be enveloped and held together with shrink film or also with expandable stretch film. In addition to the widely used film packages or film shrink packages, there are also so-called strapped packages, adhesively bonded packages and combinations of these package variants.

Some of these known package variants are in increasingly lower demand in the beverage industry due to various disadvantages. For example, the use of shrink film packaging requires different manufacturing steps with an overall comparatively high energy consumption. In addition, the film used incurs costs for manufacturing, provision, handling as well as later disposal, since it is no longer required by the end consumer after sale to them and must be treated as waste.

While the individual articles or containers in the so-called adhesively bonded packages are joined together in an adhesively bonded manner directly via their lateral surfaces by adhesive connections, without further holding means being necessary, the containers in strapped packages are held together by at least one strapping band tensioned horizontally around the containers. In order to fix the articles or containers in their intended positions in this case, it may be expedient in the case of strapped packages to apply two or more horizontal strapping bands spaced apart from one another in different positions or at different height levels.

In the case of simpler variants of such strapped packages formed with strapping bands, the bands can be formed by paper sleeves which are relatively wide for reasons of stability. Until now, however, strapping bands made of suitable plastics material have been found to be more widespread for the applications considered here. In the case of the same material thickness, such strapping bands made of plastics material generally have a higher strength and can therefore normally also be pretensioned more strongly than those made of paper, which, in particular in the case of relatively resilient thin-walled PET containers with their flexible walls which are not very dimensionally stable, allows for a very precise definition of the strapping pretension, so that the containers cannot be deformed or even damaged due to excessive pretensioning. Precise adjustment of the pretensioning can, however, also prevent a package equipped with this from becoming too unstable when handled due to excessively low pretension and can prevent the containers from being able to slip out of the package assembly.

The use of plastics bands is increasingly being considered for ecological reasons. The process-related time necessary for welding such strapping bands made of thermoplastic material can have a negative effect on the achievable package production performance, i.e. on the strapped package producible by a packaging machine in a specific unit of time.

Different variants of strapped packages for the mechanical combination of beverage containers are known from the prior art, for example from U.S. Pat. No. 6,041,572 A, where two beverage containers are held together by a strapping band horizontally surrounding the containers shown there.

U.S. Pat. No. 5,775,486 A also discloses a package arrangement with bottles or cans kept together. In the case of the package arrangement shown, rows of three or six bottles or cans are each fixed with upper-side attachments made of cardboard and kept together by strapping bands to form larger packages or package units.

DE 20 2006 000 215 U1 furthermore discloses a package which comprises goods and a packaging material tensioned around the goods. The packaging material has the form of a continuous packaging material strip which has two ends which form a common overlap region. The packaging material strip is tensioned around the goods, an overlap region of the two ends being produced. The packaging material portions formed thereby are fastened around the goods in an adhesively bonded manner by applying a force holding the packaging material portions together. For this purpose, it is proposed that an adhesive strip is applied to an outer surface of a free end of the strip-like packaging material in order to form the free end of the packaging material in a self-adhesive manner.

In practice, it has been found that strapping bands made of paper, cardboard or other pulp material generally do not have the same stability and mechanical load-bearing capacity as plastics bands, and therefore, overall, there is a greater risk of mechanical overloading and unintentional tearing of the strapping band than is the case when using tear-resistant plastics bands. There may be a risk of such a failure of the strapping band, for example, in the case of temperature-related expansions of the articles or containers kept together in the package.

A first objective of the invention is to provide a method which is easy to apply in practice for the simple and cost-effective production of such strapped packages, in which a mechanically sufficiently stable strapping is used and produced.

In addition, a further objective of the invention is to provide a suitable tool, in particular a shaping and package-forming tool for producing strapped packages produced in this way, with the aid of which stable strapped packages can be produced using a very wide range of strapping band materials.

These objectives mentioned are achieved with the subjects of the independent claims. Further advantageous embodiments are described by the dependent claims.

SUMMARY OF THE INVENTION

In order to achieve at least some of the above-mentioned objectives, the present invention proposes a method for producing strapped packages, in which at least two articles having deformable or flexible lateral surfaces are grouped and brought into a rectangular arrangement and are kept together by at least one strapping band.

Here, at least the following method steps are provided: firstly, deformation forces are applied to the group of articles and thus to the individual articles within the group at least from one side to one of the two opposite short sides of the group of articles, the deformation forces acting and/or being transmitted approximately uniformly on all articles of the group of articles. These deformation forces are expediently applied with a force component, the main direction of which is oriented approximately perpendicularly to the surface of the lateral surfaces of the respective articles, i.e. in the case of upright articles approximately horizontally.

In order to be able to apply such deformation forces from one side on one of the two short sides, the other short side of the group of articles can be supported, for example, on a stationary barrier, on a wall, on a suitable support or on another counter bearing. The short side of the group of articles that is not supported in this way, on the other hand, is subjected to the deformation forces.

Optionally, however, deformation forces are also applied to the group of articles and thus to the individual articles within the group from both sides on the opposite short sides of the group of articles, the deformation forces acting and/or being transmitted approximately uniformly on all articles of the group of articles. This variant of the force application can also provide that the deformation forces applied in this case are preferably applied with a force component, the main direction of which is oriented approximately perpendicularly to the surface of the lateral surfaces of the respective articles, i.e. in the case of upright articles approximately horizontally.

As a rule, this means that the deformation forces acting from one side on one short side or from both sides on opposite short sides of the group of articles and approximately uniformly on all articles of the group of articles are applied in a direction that is oriented approximately perpendicularly to the longitudinal center axes of the articles and approximately parallel to connecting lines which can run between the longitudinal center axes of the articles.

These applied deformation forces should also act approximately uniformly on all articles in the group of articles. This applies irrespective of whether deformation forces are applied on both short sides or whether they are applied from only one side to a short side, while the other short side is supported on a barrier or support.

After the application of the deformation forces and while maintaining the deformation forces acting on the articles, the at least one strapping band is subsequently applied to the group of articles deformed in this way, an overall length of the annularly closed strapping band corresponding to or being minimally greater than an overall circumference of the group of articles subjected to the deformation forces, since the deformation is intended to ensure that the overall circumference of the group of articles is reduced at least to the extent that the preferably unstretched and thus unlengthened strapping band can be placed around the group of articles and fixed there.

Only subsequently, i.e. after the application of the strapping band, are the deformation forces acting on the group of articles removed, as a result of which the article lateral surfaces elastically return to their original shape and bring about a defined band tensioning of the strapping band.

While it was necessary in known strapping methods to set the strapping band itself under pretension in order to place it over a group of articles to be strapped and to fix it there, the method according to the invention provides a defined change in the overall circumference of the group of articles to be strapped, which is primarily done by applying defined pretensioning forces to the articles, and not, or only secondarily, via supplementary band stretching when applying the band to the group of articles. Normally, stretching of the strapping band during application to the group of articles can be dispensed with, since the reduction of the circumference of the group of articles by applying the defined deformation forces is already sufficient to be able to apply the unstretched strapping band there.

The method according to the invention makes it possible, in particular for strapped packages with any strapping-band materials, for example also in the case of pulp-containing or paper-like strapping bands, to largely avoid unwanted failure of the strapping band due to changing and/or unclear or at least temporarily unknown article properties and thus possibly associated increased band tensions in the strapping band.

Since, in particular, beverage containers are suitable as articles in the strapped package, a compressibility and an expansion of relatively thin-walled PET containers are to be expected when there is a gasified beverage in the containers. The volume increase of a typical bottle or a typical beverage container of which the content is gassed with carbon dioxide can be in the order of magnitude of about 0.2% up to 8%, a typical expansion or volume increase being in an order of magnitude of about 1% to 4%. However, individual regions can possibly also expand more significantly, which can apply in particular to a grip region of a waisted PET bottle. In addition, the values mentioned are not only dependent on the wall thickness of the PET material of the containers, but also on the degree of carbonization of the filled product and not least on the temperature fluctuations to which the articles or containers in the strapped package are exposed after production of the latter.

Since the wall thicknesses of such PET beverage containers are also very small, the compressibility and deformability of the articles formed by deformable containers, the compressibility and deformability being required for the method according to the invention, are produced when the deformation forces acting from the outside are applied to the articles.

In the method according to the invention, the group of articles provided for the strapped package is compressed before the strapping in one axis or in two axes with a certain force, resulting in a certain deformation distance in the case of given article properties. In this way, the strapping band can be placed largely tension-free and with the smallest possible circumference at a desired height around the group of articles and connected at mutually abutting or overlapping band ends. In principle, it is also possible to use a prefabricated closed strapping band of appropriate length, which does not have band ends or contact points to be connected, but can be placed over the group of articles in the already finished state. In both cases, the band tension in the strapping band that is indispensable for the package stability arises due to the relaxation of the clamping device, i.e. by the removal of the deformation forces acting on the group of articles, and by the material forces exerted in this way by the articles elastically returning to their original shape.

The invention can provide that the at least one strapping band is a pulp-containing strapping band or a strapping band formed substantially by pulp material, which strapping band holds together the two or more surrounded articles in the group of articles. Furthermore, the at least one strapping band can have at least one overlapping and joining region, at which two band ends overlapping and placed one above the other in portions are connected to one another. The band ends are part of a band portion of defined length which is sufficient to surround the desired number of articles that are intended to form the strapped package.

As mentioned, an annularly closed, prefabricated band of appropriate length can optionally also be used as a strapping band.

In principle, the method according to the invention is also suitable for the use of strapping bands made of plastics material or generally of material other than the preferably used pulp material or pulp-containing material, but the advantages of the method are particularly evident in the case of strapping bands made of paper or cardboard.

In general, in all of the method variants explained here, the strapping designated here or the strapping band designated here can be formed by at least one single band. Optionally, the strapping or the strapping band can also be formed by two or more bands which, in this case, can be tensioned at different heights around the articles. Both variants are intended to be understood to be equivalent where the term "strapping band" or "strapping" is used.

The method preferably provides that the applied deformation forces acting from one side on a short side or from both sides on the opposite short sides of the group of articles and/or transferred mutually via the article lateral surfaces to adjacent articles are dimensioned and should be set such that a distancing of the opposite longitudinal sides of the group of articles from one another by an expansion length is thus brought about which is less than a compression length of the opposite short sides of the group of articles caused by the deformation forces, so that the strapping band can be placed around the group of articles deformed in this way.

In addition, the method provides that, after and by the removal of the deformation forces acting on the group of articles, the article lateral surfaces elastically returning to their original shape produce a defined band tension of the strapping band, the band tension holding together the articles in the strapped package. These forces predetermined by the compressibility and the elastic properties of the articles equipped with flexible lateral surfaces and compressible contents thus define the band tension and thus also the mechanical stability of the strapped package produced in this way.

Furthermore, a method variant in which a band that is not closed annularly is used can provide that, after the application of the deformation forces, the strapping band is formed by connecting band ends at at least one mutually abutting or overlapping contact point to form a closed annular strapping band, the band tension being defined according to the above explanation by elastic recoveries of the relaxed articles in the group of articles after the deformation forces have been removed.

Optionally, as already explained above, a strapping band formed by several individual parts can also be used in the method, which strapping band is formed after the application of the deformation forces by connecting band ends at at least two separate, mutually abutting or overlapping contact points to form a closed annular strapping band. In this case too, the band tension of the strapping band is defined in the same way by elastic recoveries of the relaxed articles of the group of articles after the deformation forces have been removed.

In all method variants in which band ends of the initially open band are joined together and connected to one another after application of the band to the group of articles, the overlapping band ends can be joined together adhesively at the at least one contact point of the strapping band by an adhesively bonded connection. Alternatively, the overlapping band ends can also be welded together, if this is technically possible and reasonable for the band material used.

Depending on the selected method variant, a single overlapping and joining point or a plurality of discrete overlapping and joining points, in particular two such points distanced from one another and spaced apart from one another in the direction of longitudinal extent of the strapping band, can be provided and can be formed, in particular, by adhesive spots or adhesive strips, but optionally, if technically possible and reasonable, also by welding spots, stapling, etc.

So that the strapped package produced in this way has sufficient mechanical stability, these discrete joining points must each have definable minimum adhesive forces, which can transmit the tensile forces that occur during handling and that act on the strapping band, because it may be desirable for the strapping band to not break open firstly at the joining points in the event of an overload, but for it to transmit the same tensile forces as the band itself. Under certain circumstances, however, it may also be expedient to use the joining points as defined failure points or as predetermined breaking points if it is desirable, for example, to set breaking or failure forces to a certain value or a certain region, whereby the forces acting on the band, at which the individual joining points fail, can be defined within certain limits and can be adjusted by the manufacturing method.

Optionally, the at least two joining points can be realized by adhesive surfaces which are approximately the same size or also at least slightly differently sized, which leads, in particular in the case of adhesive surfaces, to the possibly desired results of a definable strength of the joining points, since the adhesive forces in the case of planar adhesive points are usually distributed largely homogeneously over the adhesive surface, so that the adhesive forces of the adhesive surfaces can also be precisely adjusted by a variation of the size of the adhesive surfaces. Since, in the ideal case, an approximate proportionality can be assumed between the size of the adhesive surfaces and the magnitude of the adhesive forces generated by the adhesive surface, even at least in certain regions or at least in portions, the result desired under certain circumstances, according to which these adhesive forces can be defined very precisely or within narrow limits, is produced.

As already explained above, the strapped packages formed can be formed in the method according to the invention by at least two identical articles which have deformable or flexible lateral surfaces, since the strapping can already take place in the described way with a minimum configuration of this kind. Normally, however, the strapped packages are formed by four or more identical articles which have deformable or flexible lateral surfaces, the articles being grouped and brought into a rectangular arrangement, and the group of articles being deformed along a longitudinal axis of the rectangular arrangement.

In principle, more than four or six articles can also be present in the package, provided that in such larger packages a sufficient mechanical stability can be produced by one strapping band or by two or more strapping bands. The groups of articles brought into a rectangular arrangement can have a m×n rectangular arrangement, with m being at least 1 and n being at least 2.

In the case of a 1×2 arrangement (i.e. one row with only two containers or articles), only two articles are accordingly located next to each other in the group; in the case of a 2×2 arrangement (i.e. two rows of two containers or articles each), there are already four articles in a square arrangement in the group. A 2×3 arrangement accordingly comprises six articles, in which two rows of three containers each are adjacent to one another. These arrangements are intended to illustrate the principle and are therefore to be understood by way of example.

An optional additional equipping of the strapped packages produced by the method according to the invention can provide that they are additionally equipped with an additional planar packaging blank for the strapping. Such a packaging blank is normally made of planar cardboard material and has several openings which correspond to upper portions of the articles in the strapped package. In this way, the openings of the packaging blank can be pushed over upper portions of the articles and connected to them, a latching in particular being expedient, since the packaging blank can thereby stabilize and hold the articles in their position, even if, for example, the stabilizing effect of the strapping has been compromised on account of one of the joining points opening.

Such a packaging blank can optionally be applied to the group of articles before the strapping process. However, application of a packaging blank made of cardboard material or another similar material subsequently to the strapping process is also useful.

In order to achieve at least one of the above-mentioned objectives, the invention further proposes, in addition to the method proposed in several embodiment variants, a suitable tool for producing strapped packages. The strapped packages that can be produced by the tool are each formed by at least two articles having deformable or flexible lateral surfaces, the grouped articles being kept together by at least one strapping band.

The tool comprises at least first clamping jaws that are advanceable towards one another for applying, from at least one side, deformation forces acting on one of the short sides of the group of articles, and also second clamping jaws that are advanceable towards one another and which are prepared and equipped to apply the strapping band located between the first clamping jaws and the short sides of the group of articles to the opposite longitudinal sides.

In an embodiment variant with deformation forces applied from one side to one of the two short sides of the group of articles, it may be sensible, for example, to design one of the two clamping jaws that are advanceable towards one another to be movable, while the other clamping jaw can be designed to be stationary and can serve, for example, as a barrier or support.

In an embodiment variant of the tool according to the invention, the first clamping jaws can also be designed to be advanceable towards one another, but in this case serve to apply deformation forces acting from both sides on the opposite short sides of the group of articles.

In addition, the tool according to the invention comprises fixing devices for connecting mutually abutting or overlapping band portions between the first and second clamping jaws in each instance bearing against the short sides and against the longitudinal sides in order to fix the strapping band.

Preferably, the strapping band processed with the tool and looped around the group of articles has an overall length which corresponds to or is minimally greater than an overall circumference of the group of articles subjected to the deformation forces by the first clamping jaws. In this way, the clamping jaws of the tool can be moved in such a way that a band tension of the closed strapping band can be defined by an elastic recovery of the relaxed articles in the group of articles after removal of the first clamping jaws and the associated removal of the deformation forces.

By the fixing device, in particular sticking points or adhesive points are applied, whereby the overlapping band ends of the multi-part strapping band are joined together and connected to one another, i.e., the joints are each formed by adhesive points in this case.

Optionally, the fixing device can also provide for welding and or mechanically connecting in some other way the mutually abutting or overlapping band ends of the strapping band to be joined there. However, a strapping band made of plastics material is normally to be used for this purpose, while the adhesive bonding can expediently be applied in the case of a pulp-containing strapping band or a strapping band consisting of pulp material, of paper, cardboard or similar material.

In principle, a prefabricated, annularly closed strapping band could also be used, although this might be more difficult to process by the tool according to the invention because it would have to be pushed from above or from below over the compressed group of articles. In this case, however, the clamping jaws with which the deformation forces acting on the group of articles and reducing the overall circumference thereof are applied would be in the way, and therefore a path would have to be found in order to move the strapping band past the clamping jaws. For this reason, by the tool according to the invention, a multi-part strapping band or a strapping band that is open at at least one location is expediently processed in such a way that it can be converted into a closed strapping band by the fixing devices at the at least one joining point.

According to a further embodiment variant of the tool according to the invention, the clamping jaws can be adapted at least in portions to the contours of the articles that are arranged in the group of articles and that are contacted in each instance on their lateral surfaces. Since the articles are, in particular, PET beverage containers with flexible lateral surfaces, it is expedient to contact these relatively resilient surfaces with correspondingly contoured clamping jaws in order to avoid point or line loads at some locations on the article lateral surfaces. In this way, the clamping jaws can, for example, follow the particular convexly curved outer contour of the article in question in their concave contour and can ensure a gentle deformation during the application of the deformation forces.

According to a further embodiment variant, the tool can be configured in such a way that the sticking points can be applied in regions between adjacent articles. For the fixing devices which can ensure a connection of the mutually abutting or overlapping band ends at the at least one joining point, it is generally more advantageous if they can engage in portions where there is no article lateral surface, i.e., in regions between adjacent articles which are spanned by the tautened strapping band and where the article lateral surfaces are drawn inwardly in a V shape. In this way, suitable counter bearings can also be positioned during the pressing of the band ends, which is more favorable for forming firmly adhering adhesive points in which case the band ends provided with adhesive are pressed against one another.

The strapping band can be formed in particular by two band portions to be connected at overlapping band ends, it being possible for the joining points to be arranged offset to one another, i.e., not opposite in the group, depending on the configuration of the group of articles. In the case of a 2×3 container with a total of six articles of the same dimensions, two band portions of equal length can be joined together in this way, without the joining points resting directly on the article lateral surfaces. If the joining points are arranged offset to one another, they can be positioned in each instance in regions between adjacent articles that are spanned by the tautened strapping band and where the article lateral surfaces are drawn inwardly in a V shape.

The clamping jaws of the tool hold the articles in the group of articles preferably at the side, i.e., from all sides, clamping jaws arranged in each instance opposite one another in pairs ensuring the application of the deformation forces (first clamping jaws), while the other clamping jaw pair (second clamping jaws) can ensure the guidance of the group of articles and the prevention of evasive movements of individual articles and also can ensure the guidance and application of the strapping band. In the case of a group of articles brought into a rectangular arrangement, the first clamping jaw pair preferably engages from both sides on the opposite short sides of the group of articles, while the second clamping jaws that are advanceable towards one another are arranged offset thereto by 90° and are applied to the longitudinal sides of the group of articles.

In this case, the strapping band can also already be held and guided with the first clamping jaws and thus can be arranged between first clamping jaws and outer lateral surfaces of the relevant articles in contact therewith. With the second clamping jaws, the portions of the strapping band adjacent thereto are brought up to and placed against the group of articles. In addition, the fixing devices are placed against the strapping band with the second clamping jaws and ensure the adhesive bonding (or welding) of the overlapping band ends at the joining points.

In general, the tool can be used with groups of articles in which the formed strapped packages are formed by at least two identical articles having deformable or flexible lateral surfaces, the articles being grouped and brought into a rectangular arrangement, and the groups of articles being deformed along a longitudinal axis of the rectangular arrangement. The groups of articles generally have a m×n rectangular arrangement, with m being at least one and n being at least two. A typical group of articles with a total of six articles has a 2×3 rectangular arrangement.

It should be expressly mentioned at this point that all aspects and embodiment variants which have been explained in conjunction with the tool according to the invention for producing strapped packages may equally also relate to, or form, partial aspects of the method according to the invention. Therefore, if the description or the claim definitions pertaining to the tool according to the invention make mention of certain aspects and/or correlations and/or effects, this applies equally to the method according to the invention. The same applies vice versa, so that all aspects and embodiment variants which have been explained in conjunction with the method according to the invention can also relate to, or be, partial aspects of the tool according to the invention. Therefore, if the description or the claim definitions pertaining to the method according to the invention make mention of certain aspects and/or correlations and/or effects, this applies equally to the different variants of the tool according to the invention.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

FIG. 1A to 1E show, in total, five schematic plan views of the basic process sequence in the production of strapped packages by a variant of the method according to the invention.

FIG. 6A to 6C show, in total, three different views of further embodiment variants of individual components of a tool for producing strapped packages.

DETAILED DESCRIPTION OF THE INVENTION

Figure 1D:
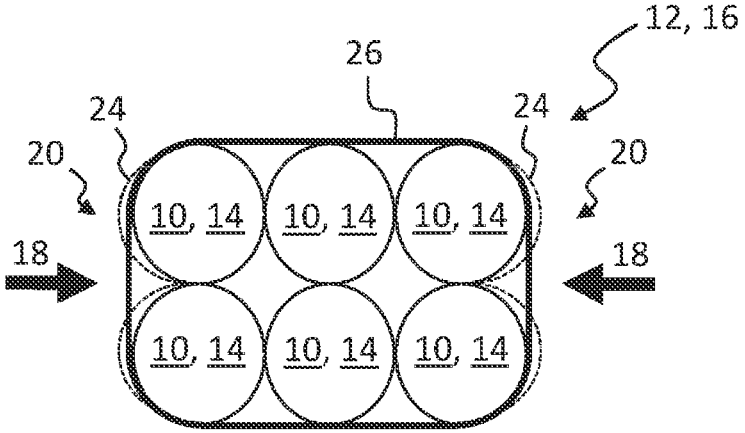

Identical reference numerals are used for identical elements of the invention or those having the same effect. Furthermore, for the sake of clarity, in the individual figures only reference signs that are required for the description of the figure in question are shown. The illustrated embodiments merely represent examples of how the method according to the invention for producing packages or the tool according to the invention for handling and/or producing packages may be designed, and do not represent a definitive limitation.

The schematic plan views of FIG. 1A to 1E illustrate some of the fundamentally important aspects which must be observed in conjunction with the strapping of groups of articles and the occurring deformation processes of the articles within the groups.

As can be seen from the schematic plan view of FIG. 1A, a total of six such articles 10 can, for example, be put together and, according to the further schematic plan view of FIG. 1B, can be brought into a rectangular arrangement, which is also referred to in the present context as a group of articles 10. In this group 12 of articles, two parallel rows each having three articles 10 are pushed together in an arrangement so that the articles 10 aligned in the two parallel rows are each adjacent to each other in pairs and form the regular rectangular arrangement of the group 12 of articles.

The method according to the invention which is illustrated here on the basis of an exemplary embodiment in schematic plan view representations serves to produce strapped packages which are formed by a plurality of grouped articles 10 and are held together by at least one strapping band.

The articles 10 have deformable and/or flexible lateral surfaces and can typically be formed by thin-walled PET beverage containers which have a cylindrical lateral surface at least in portions. These containers or beverage containers made of thin and flexible plastics material such as PET are designated by reference numeral 14 in the present context. Thus, if articles 10 or groups 12 of articles are referred to generally in the present context, these can be, in particular, containers 14 or beverage containers 14 and groups 16 of containers formed therefrom. Accordingly, FIG. 1A shows six containers 14 to be assembled together, which, according to FIG. 1B, are pushed together to form a 3×2 group 16 of containers in a rectangular arrangement.

Before a strapping band can be applied to the group 12 of articles or group 16 of containers brought into a rectangular arrangement, deformation forces 18 are applied from both sides to opposite short sides 20 of the group 12, 16 of articles or containers and are indicated in FIG. 1C by force arrows directed from both sides onto the short sides 20 of the groups 12, 16 of articles or containers.

In principle, it is also conceivable, in deviation from the force applied from both sides to the group 16 of containers shown in FIGS. 1C and 1D, to apply effective deformation forces 18 from only one of the two short sides 20, while the opposite short side 20 is supported against a barrier or wall or the like. In this way, the same effect can be achieved as described here, namely the largely uniform deformation of the articles 10 or containers 14 and the reduction of the outline length of the group 12, 16 of articles or containers in order to be able to apply the strapping band.

As can be seen from the parentheses between the force arrows, which represent the deformation forces 18, and the short sides 20 of the group 12, 16 of articles or containers comprising the two articles 10 or containers 14 located next to one another, the deformation forces 18 are intended to act uniformly on the two articles 10 or containers 14 on each of the two short sides 20, as a result of which the deformation forces 18 are transmitted uniformly to all articles 10 or containers 14 of the group 12, 16 due to the articles 10 or containers 14 of the group 12, 16 being arranged in contact with one another.

As illustrated by FIG. 1C, the deformation forces 18 are applied with a main direction approximately perpendicular to the surface of the lateral surfaces of the respective articles 10 or containers 14, i.e., in the case of upright articles 10 in an approximately horizontal direction, i.e. in a direction parallel to the plane of the drawing. This means that the deformation forces 18 acting from both sides on the opposite short sides 20 of the group 12 of articles or group 16 of containers and approximately uniformly on all articles 10 in the group 12 of articles or containers 14 in the group 16 of containers are applied in a direction that is oriented approximately perpendicularly to the longitudinal center axes of the articles 10 or containers 14 and approximately parallel to connecting lines which can run between the longitudinal center axes of the articles 10 or containers 16. Since these applied deformation forces 18 also act approximately uniformly on all articles 10 in the group 12 of articles or on all containers 14 in the group 16 of containers, the articles or containers also deform uniformly.

The degree of deformation is indicated in FIG. 1C by the container outlines 22, which deform in an oval manner, of each of the total six containers 14 in the group 16 of containers, which deviate from the undeformed cylindrical container outlines 24. In order to make this deformation of the containers 14 qualitatively visible, the original and undeformed container outlines 24 are shown by dashed lines, from which the container outlines 22 deformed in an oval manner differ discernibly. Due to the acting deformation forces 18, the longer main axes (not shown) of the container outlines 22 deformed in this way are oriented perpendicular to the forces, so that the shorter secondary axes (likewise not shown) of the deformed container outlines 22 are oriented parallel to the force directions of the deformation forces 18.

After the articles 10 or containers 14 in the manner shown have been brought by the deformation forces 18 acting from both sides on the short sides 20 of the group 12 of articles or group 16 of containers in the manner shown into the contours which are deformed in an oval manner by the shown container outlines 22 and, in this way, the two short sides 20 have been brought at least slightly closer together, at least one strapping band 26 is applied according to FIG. 1D against or onto the group 12, 16 of articles or containers deformed in this way while maintaining the deformation forces 18 acting on the articles 10 or containers 14.

As can be seen from FIG. 1D, a total length of the strapping band 26 shown here as an annularly closed band can correspond approximately to an overall circumference of the group 12, 16 of articles or containers subjected to the deformation forces 18 or can be minimally greater than the overall circumference. As can be seen by the outline of the strapping band 26 placed around the deformed group 12, 16 of articles or containers and by the container outlines 24 of the undeformed articles 10 or containers 14 projecting beyond the overall circumference of the undeformed group 12, 16 of articles or containers, only the deformation shown makes it possible for the overall circumference of the group 12, 16 of articles or containers to be reduced at least to the extent that the preferably unstretched and thus unlengthened strapping band 26 can be placed around the group 12, 16 of articles or containers and fixed there.

Figure 1E:
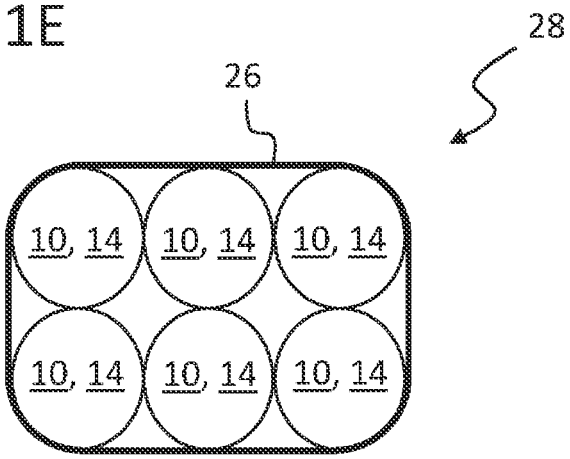

According to FIG. 1E, after the application of the strapping band 26, the deformation forces 18 acting on the group 12, 16 of articles or containers are removed, whereby the article or container lateral surfaces elastically return at least partially to their original shape and bring about a defined band tensioning of the strapping band 26. This band tensioning brought about by the elastic return of the articles 10 or containers 14 to their original shape ensures that the strapped package 28 formed in this way is firmly held together mechanically in the desired way.

Figure 2A:
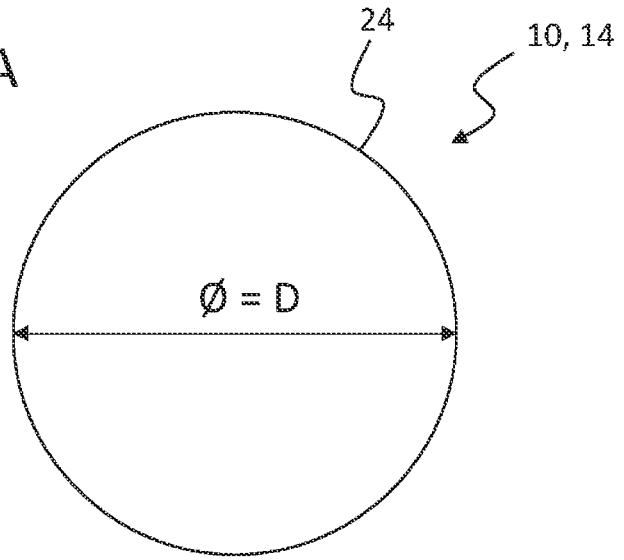
FIG. 2A and FIG. 2B show, in two schematic representations, the deformation behavior of a cylindrical article or container, which is part of a strapped package, in particular one according to the present description.
Figure 2B:
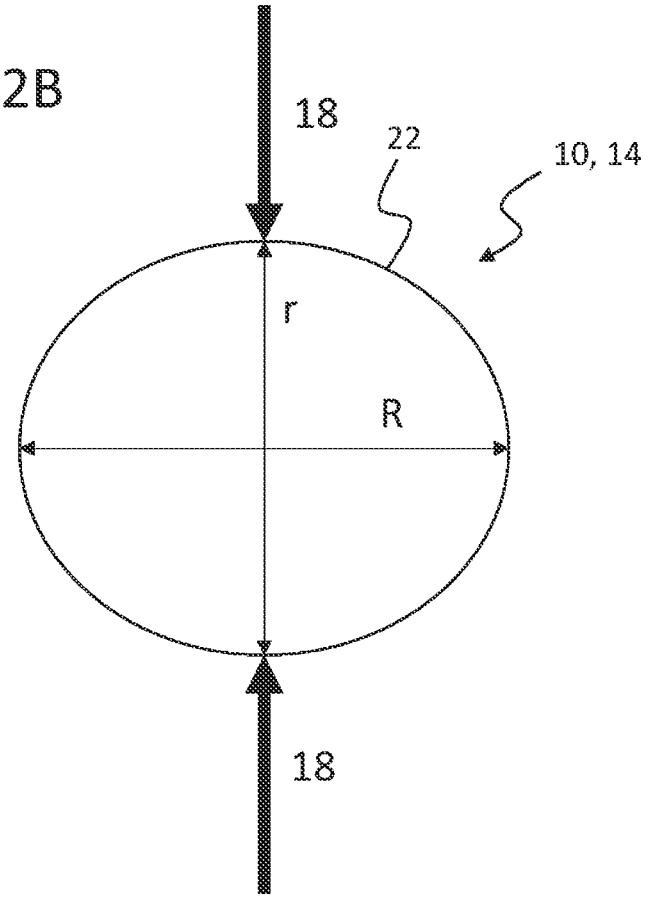

With reference to FIGS. 2A and 2B, the differences are to be illustrated which result from the application of the deformation forces 18 shown in FIGS. 1C and 1D to the opposite short sides 20 compared to an alternative deformation, not shown here, of the longitudinal sides of the group 12, 16 of articles or containers. The following numerical details for the representations in FIGS. 2A and 2B were determined experimentally.

For example, FIG. 2A shows a schematic plan view of an undeformed container outline 24 of a cylindrical article 10 or container 14. The container 14 can be formed, for example, by a thin-walled beverage container 14 made of PET plastics material. A typical beverage container having a content of 1.5 liters can have, for example, an externally measured container diameter D of 92.3 millimeters.

By applying a deformation force 18 of about 270 Newtons acting on the container lateral surface from both sides, a compression in the direction of the applied deformation forces 18 by an amount of 6.3 millimeters can be achieved according to FIG. 2B. However, this compression is accompanied by a width increase of only 2.9 millimeters, so that a possibility of reducing the overall circumference of the group 12, 16 of articles or containers according to FIGS. 1C and 1C results from this.

The undeformed container 14 has the diameter D shown in FIG. 2A of 92.3 mm in any direction, thus has a substantially cylindrical contour.

In the case of the deformation according to FIG. 2B, in which the overall circumference of the container 14 does not change, an elliptically deformed contour 22 with the longer main axis R transverse to the deformation direction and with the shorter secondary axis r in the direction of the applied deformation is created from the cylindrical, undeformed contour 24.

Since, due to the applied deformation forces 18, the secondary axis r is shortened to a greater extent, by reduction of the original container diameter D, than the main axis R is extended, the circumferential reduction shown in FIGS. 1C and 1D results in the overall group 16 of containers, which permits application of the strapping band 26 in the manner shown. As a result of elastic recovery and corresponding shortening of the main axis R and extension of the secondary axis r, the overall circumference of the group 16 increases, so that the strapping band 26 is under defined pretension in the finished strapped package 28, which in turn ensures the mechanical holding together of the strapped package 28.

The values already mentioned above can apply as an example. At the mentioned deformation force 18 of approximately 270 N, the length of the secondary axis r can be reduced from, originally, 92.3 mm (original diameter D of the cylindrical container 14) to a value of about 86 mm. Likewise, the deformation force 18 results in an extension of the main axis R of the now elliptically deformed container 14 from, originally, 92.3 mm to 95.2 mm. The extension of the main axis R of just 3 mm is only at most half the shortening of the secondary axis r (6.3 mm), so that, overall, and distributed over all six containers 14 of the group 16 of containers assembled in the rectangular arrangement, the desired circumferential reduction can be achieved, which enables the application of the strapping band 26 with subsequent production of a defined band tension.

The shape changes that can be achieved in this way also illustrate why it is more favorable in the case of a rectangular arrangement of such a group 16 of containers to allow the deformation forces 18 to act on the short sides 20 with the two adjacently arranged containers 14 and not on the longitudinal sides with the three adjacently arranged containers 14. The deformations of three containers 14 located in rows and having the diameter D, mentioned by way of example above, of 92.3 mm in each instance can add up in such a way and be used for an overall length reduction of the group 16 of containers of approximately 19 mm (3×6.3 mm), while the summed increase in width of the containers 14 arranged adjacently to one another in two rows of three is only approximately 6 mm (2×2.9 mm).

It should be pointed out that the dimensions indicated relate to an exemplary embodiment and can deviate from the above values depending on the container volume, container contour, wall thickness of the containers, container contents (heavily gassed or more weakly gassed) and other parameters. However, the basic principle and the basic possibility of acting on the group 12, 16 of articles or containers are intended to be illustrated by the exemplary embodiment in order to produce a strapped package 28 with a defined band tension by application of a strapping band 26.

As is clear from the following description of different method variants using a strapping tool provided for this purpose (cf. FIG. 3A et seqq.), in the production of the strapped packages 28, in particular a multi-part strapping band 26 can be used, which is adhesively bonded, welded or otherwise connected at defined joining points, as long as the group 12, 16 of articles or containers has a reduced outer circumference under the action of the deformation forces 18. As soon as the joining points have reached their strength, which requires a certain curing time in particular in the case of adhesive points, the deformation forces 18 can be removed and the strapping band 26 can be set under defined band tension by expansion of the previously deformed articles 10 or containers 14.

Optionally, however, a prefabricated closed band can also be used as strapping band 26, the length of which is matched to the deformed group 12, 16 of articles or containers, so that, after the elastic recovery of the previously elliptically deformed articles 10 or containers 14, it is tensioned and holds the strapped articles 10 or containers 14 together with a defined band tension. However, the use of such a closed band 26 requires that the tool head used for the strapping can reliably handle both the deformation of the group 12, 16 of articles or containers and also the application of the strapping band 26, without collisions or disturbances between the band and the tool head taking place here.

Since the application of a prefabricated closed strapping band 26 in the case of a deformed group 12, 16 of articles or containers in most cases should require mechanically complex measures for trouble-free handling of the package components to be connected to one another, the following method examples relate to multi-part strapping bands 26, which are joined together at their joining points to form a closed strapping band 26 only after application to the deformed group 12, 16 of articles or containers.

The schematic plan views of FIG. 3A to 3E show first successive method steps of a first method variant when using a tool 30 for producing strapped packages 28 according to FIG. 1E.

The tool 30 used in accordance with FIG. 3A to 3E for the production of the strapped package 28 can also be considered as a strapping head 32, by which the essential process steps for strapping the group 12, 16 of articles or containers and for ensuring the band tension indispensable for mechanically holding together the articles 10 or containers 14 in the package 28 are carried out.

Figure 3A:
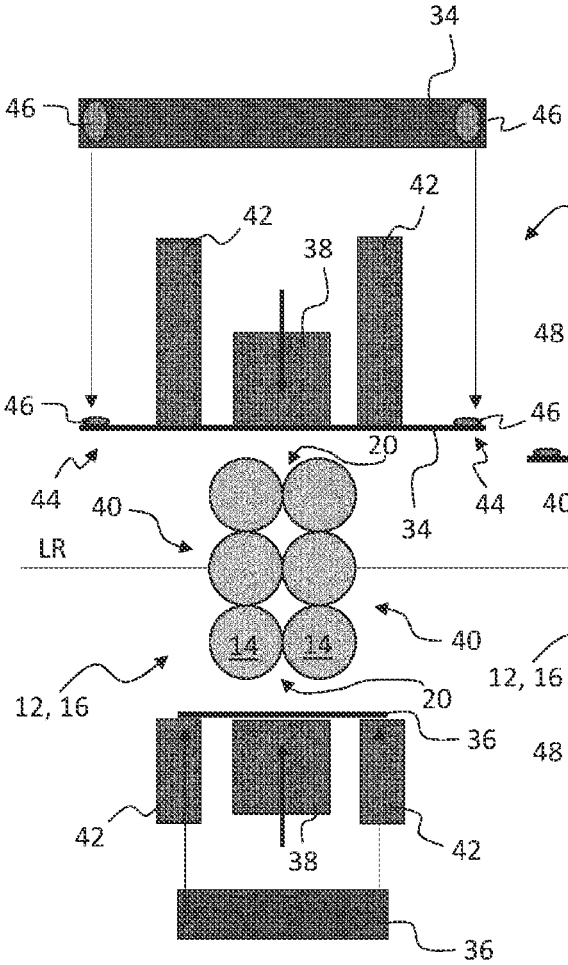
FIG. 3A to 3E show, in total, five schematic plan views of successive process steps of a first method variant of the method according to the invention for producing strapped packages.
Figure 3B:
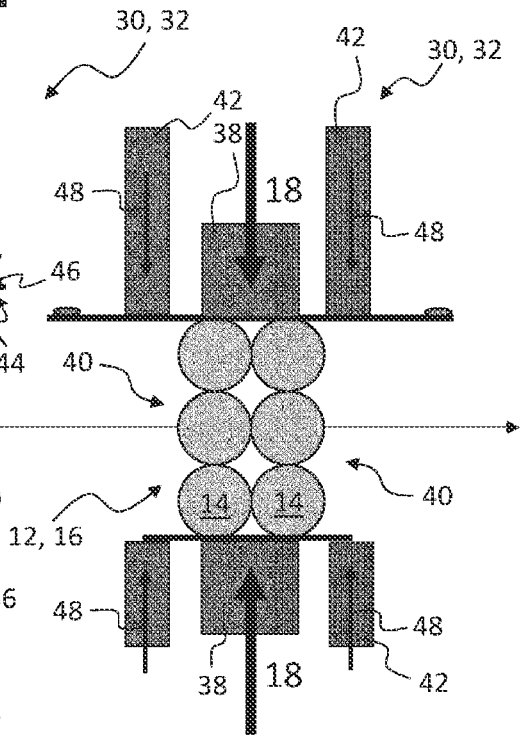
Figure 3C:
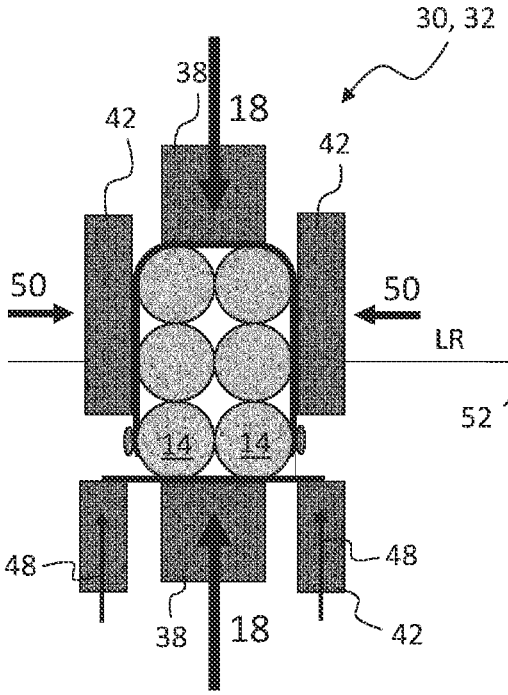

As is initially clear from the schematic plan views of FIG. 3A to 3C, a group 16 of containers, which is arranged in a rectangular arrangement and is formed by a total of six cylindrical containers 14 each with deformable or flexible lateral surfaces, is provided and brought into the effective region of a strapping head 32 forming the stated tool 30 (FIG. 3A).

Figure 3D:
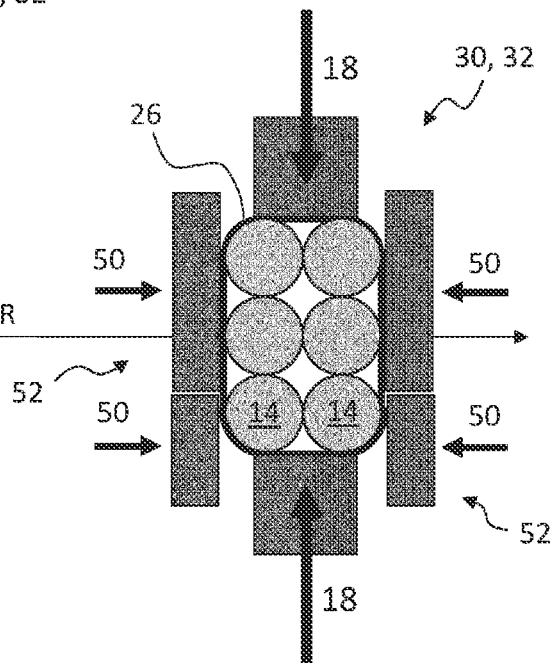

Since the group 16 of containers and/or the strapping tool 30 are optionally moved from the left to the right in a conveying direction or direction of travel LR, while the successive process steps are carried out, this direction of travel LR is shown across all of FIG. 3A to 3E as a continuous arrow, the method sequence being intended to continue seamlessly from FIG. 3C to FIG. 3D, even if the arrow is interrupted here for drawing purposes.

According to FIG. 3A, two band portions 34 and 36 are each applied to first clamping jaws 38 of the strapping head 32 or inserted there in such a way that the band portions 34 and 36 are each guided and held by suitable associated contact or holding surfaces (not shown) of the clamping jaws 38, without being able to slip or fall out. The first clamping jaws 38 can each be moved in pairs from both sides towards and against the short sides 20 of the group 16 of containers. These first clamping jaws 38 simultaneously also serve to apply the deformation forces 18 required for the deformation of the containers 14 of the group 16 of containers, as illustrated in FIGS. 3B, 3C and 3D.

In addition, the tool 30 or the strapping head 32 has second clamping jaws 42 which can be advanced towards one another or can be applied against the longitudinal sides 40 of the group 16 of containers and which serve substantially to apply the strapping band 26 located between the first clamping jaws 38 and the short sides 20 of the group 16 of containers against the opposite longitudinal sides 40, but which do not generate any deformation forces or exert such forces on the group 16 of containers.

The first and second clamping jaws 38 and 42 located on the left short side 20 of the group 16 of containers in the direction of travel LR hold and guide the longer band portion 34, which in addition is provided at each of its band ends 44 with an adhesive application 46 consisting of hot glue. These first and second clamping jaws 38 and 42 with the longer band portion 34 are shown in FIG. 3A above the group 16 of containers.

The first and second clamping jaws 38 and 42 located on the right short side 20 of the group 16 of containers in the direction of travel LR hold and guide the shorter band portion 36, which has no adhesive application at its band ends 44. The band ends 44 of the shorter band portion 36 are grasped just by the second clamping jaws 42, so that these can place the band ends 44 around the short side 20 of the group 16 of containers in order to guide them onto the respective adhesive applications on the band ends of the longer band portion 34 and to be able to press them on there in order to thus form the joining points (see FIG. 3D).

These first and second clamping jaws 38 and 42 with the shorter band portion 36 are shown in FIG. 3A below the group 16 of containers.

In FIG. 3A, the two band portions 34 and 36 are additionally shown in a plan view, the longer band portion 34 with the adhesive applications 46 applied to the band ends 44 being shown above the strapping head 32, while the shorter band portion 36 without adhesive applications is drawn below the strapping head 32. These band portions 34 and 36 are inserted into the tool head 32 in the manner shown in FIG. 3A, so that they rest against the respective first and second clamping jaws 38 and 42 and are prepared for the guidance towards the group 16 of containers.

As shown in FIGS. 3A and 3B, the end faces of the first and second clamping jaws 38 and 42 facing the two short sides 20 of the group 16 of containers are each located at the same height and are initially guided synchronously towards the group 16 of containers (FIG. 3B) until a respective central portion of the longer or shorter band portion 34 or 36, which are guided and held by the respective first clamping jaws 38, rest against the corresponding short side 20 of the group 16 of containers.

As soon as this is the case, according to FIG. 3B, the first clamping jaws 38 can be moved further towards one another by a small amount in order to apply at least a part of the required deformation forces 18 to the short sides 20 of the group 16 of containers and to thereby deform all containers 14 in the group 16 approximately elliptically, as a result of which the longitudinal sides 40 of the group move slightly away from one another parallel to the direction of travel LR.

Since, when the maximum deformation forces 18 are applied, there is a risk that the containers 14 will move away from one another and leave the rectangular formation, the second clamping jaws 42 are expediently moved in the manner shown in FIG. 3C against the longitudinal sides 40 of the group 16 of containers before the first clamping jaws 38 are fully advanced in the direction transverse to the direction of travel LR, by the second clamping jaws being displaced transversely to the direction of travel LR of the group 16 of containers in the direction parallel to the first clamping jaws 38, but by a significantly further distance along the longitudinal sides 40 of the group 16 of containers.

The mentioned advancing movements of the second clamping jaws 42 located on the left side of the group 16 of containers in the direction of travel LR are denoted by the reference numeral 48 in FIG. 3C. These advancing movements 48 of the second clamping jaws 42 located on the left side of the group 16 of containers in the direction of travel LR simultaneously ensure that the longer band portion 34 guided by the second clamping jaws 42 is placed around the group with contact, without the second clamping jaws 42 in this case reaching the adhesive application 46 with the hot glue located at each band end 44. This adhesive application 46 with hot glue must remain free because the band ends 44 of the shorter band portion 36 are pressed thereon in order to be able to adhesively bond the joining points.

If the second clamping jaws 42 located on the left side of the group 16 of containers in the direction of travel LR lie, in the manner shown in FIG. 3C, against the longitudinal sides 40 of the group 16 of containers, the group is prevented from moving apart, so that the maximum deformation forces 18 required for the desired container deformation can now be introduced via the first clamping jaws 38 onto the short sides 20 of the group 16 of containers.

At the same time, in the process phase shown in FIG. 3C, it is expedient to exert defined holding forces 50 from both sides in the direction parallel to the direction of travel LR onto the two longitudinal sides 40 of the group 16 of containers by the second clamping jaws 42, which can serve for the fixed pressing of the longer band portion 34, for the avoidance of folds or loops in the band portion 34, and for the reliable fixing of the containers 14 in the group 16, so that the latter cannot leave the rectangular arrangement.

After the application of the longer band portion 34 shown in FIG. 3C to the longitudinal sides 40 of the group 16 of containers, the band ends 44 with the adhesive applications 46 located thereon comprising hot glue remaining free and not being reached by the second clamping jaws, in the next process step the second clamping jaws 42, which are located on the right side of the group 16 of containers in the direction of travel LR, can be moved towards the longitudinal sides 40 of the group 16 of containers in the manner shown in FIG. 3D by the advancing movements 48 directed perpendicularly to the direction of travel LR (cf. FIG. 3C) by being displaced transversely to the direction of travel LR of the group 16 of containers in the direction parallel to the first clamping jaws 38, but by a slightly further distance along the longitudinal sides 40 of the group 16 of containers.

The mentioned advancing movements of the second clamping jaws 42 located on the right side of the group 16 of containers in the direction of travel LR are again denoted by the reference numeral 48 in FIG. 3C. These advancing movements 48 of the second clamping jaws 42 located on the right side of the group 16 of containers in the direction of travel LR simultaneously ensure that the shorter band portion 36 guided by the second clamping jaws 42 is placed around the group with contact, more specifically with overlap of the adhesive application 46 comprising the hot glue located at each band end 44 by the band ends 44 of the shorter band portion 36, so that the band ends 44 of the shorter band portion 36 overlapping in this region lie on top of the band ends 44 of the longer band portion 34 and are adhesively bonded to them by application of the holding forces 50 (cf. FIG. 3D) whilst being pressed on at least slightly.

As mentioned, in the process phase shown in FIG. 3D, it is expedient to exert, by the second clamping jaws 42, which are arranged on the right side of the group 16 of containers in the direction of travel LR, defined holding forces 50 from both sides in a direction parallel to the direction of travel LR onto the short portions, which can be reached by the second clamping jaws 42, on both longitudinal sides 40 of the group 16 of containers, which can serve for the fixed pressing of the band ends 44 of the shorter band portion 36 during the adhesive bonding thereof to the band ends 44, provided with hot glue, of the longer band portion 34 and to reliably fix the containers 14 in the group 16 so that the strapped package 28 can be finished in this way in the desired manner.

The total of two first clamping jaws 38 and the total of four second clamping jaws 42 described here in terms of their cooperation, which can each be advanced in pairs towards one another, thus form, in conjunction with the previously performed application of the adhesive applications 46, fixing devices 52 which are to be designated generally as such, which form an important component of the tool 30 formed by the shown strapping head 32 for producing the strapped packages 28.

Figure 3E:
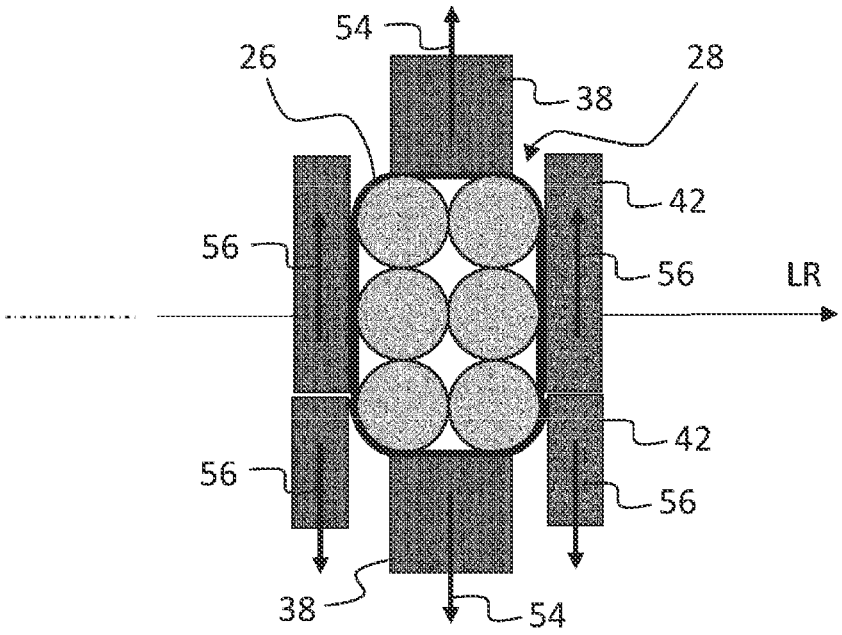

After the curing of the adhesive points at the joining points, i.e., at the regions of the overlapping band ends 44 of the shorter and longer band portions 36, 34, the two pairs of second clamping jaws 42 and the pair of first clamping jaws 38 can be moved away from the finished strapped package 28 in the directions shown in FIG. 3E, which is indicated by arrows illustrating return movements 54 of the first clamping jaws 38 and return movements 56 of the second clamping jaws 42.

Both the return movements 54 of the first clamping jaws 38 and the return movements 56 of the second clamping jaws 42 oriented parallel thereto are naturally oriented perpendicularly to the direction of travel LR of the group 16 of containers or of the finished strapped package 28 shown in FIG. 3E.

Since, after the removal of the deformation forces 18 and after the removal of the clamping jaws 38 and 42, the containers 14 of the strapped package 28 attempt to return to their original shape, and since the strapping band 26 placed around the group 16 of containers has an overall length after its adhesive bonding that is slightly smaller than an overall circumference of the relaxed containers 14 kept together in the strapped package 28, a defined band tension of the closed strapping band 26 is brought about.

The strapping band 26 used in the strapping method according to FIG. 3A to 3E can optionally be manufactured from a suitable pulp material, such as paper or cardboard, or from a composite material. In principle, a plastics band consisting of PET material, for example, is also suitable as the strapping band 26, provided that it can be adhesively bonded in the described way in a mechanically loadable manner.

The schematic plan views of FIG. 4A to 4E further show successive method steps of a second method variant when using a tool 30 or a strapping head 32 for producing strapped packages 28 according to FIG. 1E.

Figure 4A:
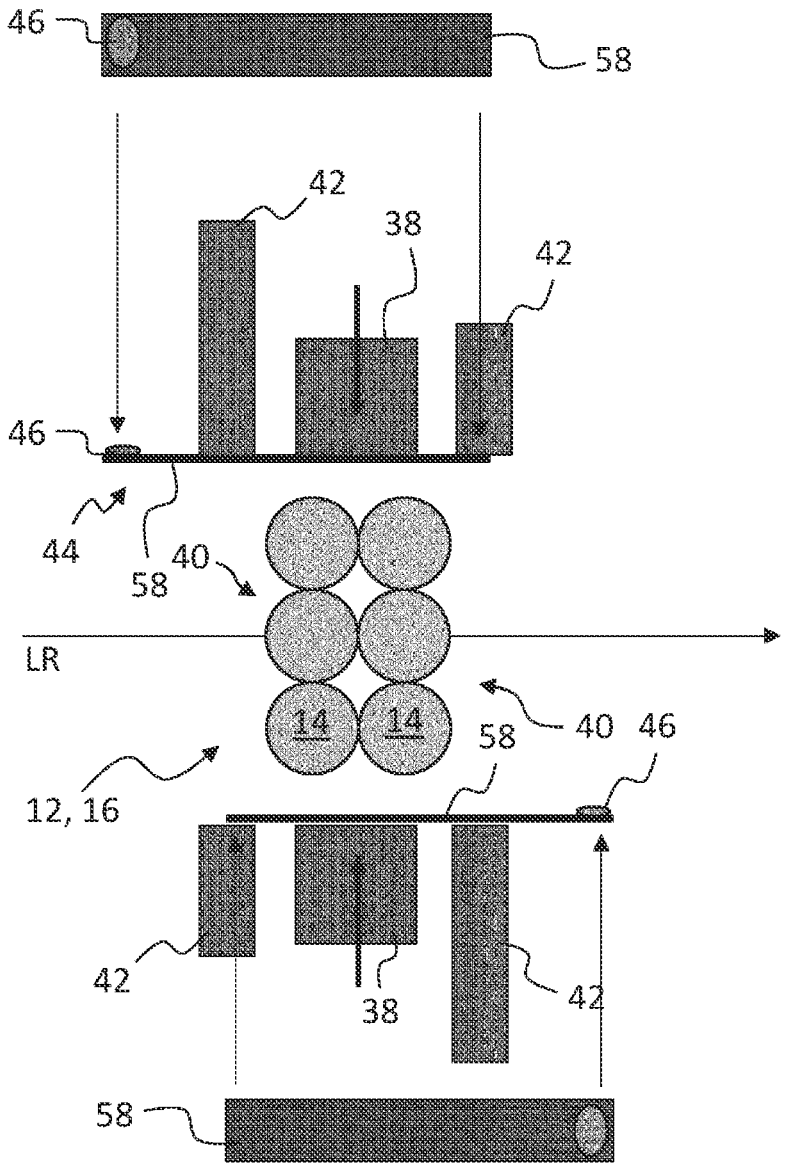
FIG. 4A to 4E show, in total, five schematic plan views of successive process steps of a second method variant of the method according to the invention for producing strapped packages.
Figure 4B:
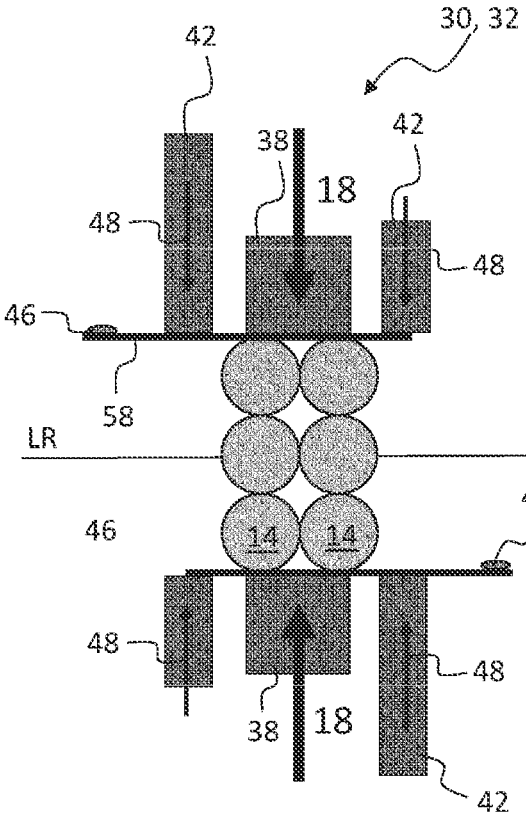
Figure 4C:
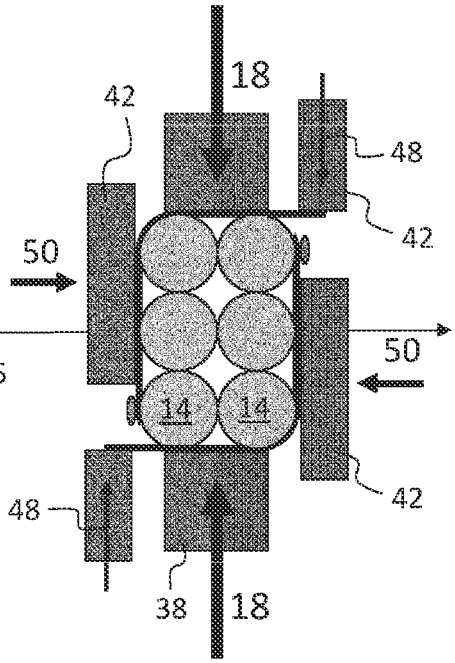

As is clear from the schematic plan views of FIG. 4A to 4C, a group 16 of containers, which is arranged in a rectangular arrangement and is formed by a total of six cylindrical containers 14 each with deformable or flexible lateral surfaces, is provided and brought into the effective region of a strapping head 32 forming the stated tool 30 (FIG. 4A). In this respect, the second method variant explained here does not differ from the previously explained first method variant (cf. FIG. 3A to 3E).

Figure 4D:
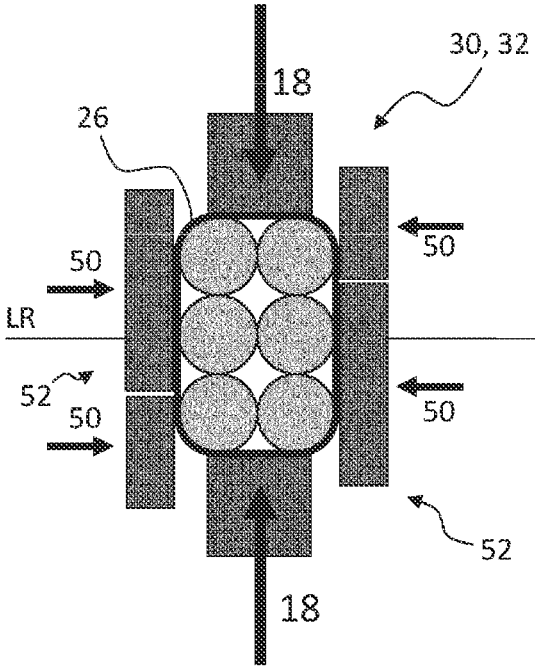

Since the group 16 of containers and/or the strapping tool 30 or the strapping head 32 are optionally moved from the left to the right in the conveying direction or direction of travel LR shown, while the successive process steps are carried out, this direction of travel LR is shown across all of FIG. 4A to 4E as a continuous arrow, the method sequence being intended to continue seamlessly from FIG. 4C to FIG. 4D, even if the arrow is interrupted here for drawing purposes.

According to FIG. 4A, two band portions 58 of uniform or the same length are each applied to first clamping jaws 38 of the strapping head 32 or inserted there in such a way that the band portions 58 are each guided and held by suitable associated contact or holding surfaces (not shown) of the clamping jaws 38 without being able to slip or fall out. The first clamping jaws 38 can each be moved in pairs from both sides towards and against the short sides 20 of the group 16 of containers. These first clamping jaws 38 simultaneously also serve to apply the deformation forces 18 required for the deformation of the containers 14 of the group 16 of containers, as illustrated in FIGS. 4B, 4C and 4D.

In addition, the tool 30 or the strapping head 32 has second clamping jaws 42 which can be advanced towards one another or can be applied against the longitudinal sides 40 of the group 16 of containers and which serve substantially to apply the strapping band 26 located between the first clamping jaws 38 and the short sides 20 of the group 16 of containers against the opposite longitudinal sides 40, but which do not generate any deformation forces or exert such forces on the group 16 of containers.

Since the band portions 58 are of the same length on both sides of the group 16 of containers moving in the direction of travel LR and, in contrast to the previously described method variant, there are no shorter or longer band portions, this is a symmetrical structure on both sides of the group 16 of containers, i.e., on the two short sides 20 thereof. A first band portion 58 is thus held and guided at the first and second clamping jaws 38 and 42 located on the left of the group 16 of containers in the direction of travel LR, the band portion 58 being provided at one of its band ends 44 with an adhesive application 46, consisting of hot glue. This band end 44 with the adhesive application 46 projects further beyond the corresponding second clamping jaw 42 than the other band end 44 projects beyond the second clamping jaw 42 located there.

The first and second clamping jaws 38 and 42 described here with the band portion 58 held thereon are shown in FIG. 4A above the group 16 of containers. In this case, the longer band end 44 with the adhesive application 46 located thereon projects beyond the second clamping jaw 42, which is located at the rear with respect to the direction of travel LR, counter to the direction of travel LR.

The first and second clamping jaws 38 and 42 located on the right short side 20 of the group 16 of containers in the direction of travel LR hold and guide the further band portion 58 of the same length, which likewise has an adhesive application 46, formed by hot glue, at one of its band ends 44. This band end 44 with the adhesive application 46 again projects further beyond the corresponding second clamping jaw 42 than the other band end 44 projects beyond the second clamping jaw 42 located there.

The first and second clamping jaws 38 and 42 described here with the band portion 58 held thereon are shown in FIG. 4A below the group 16 of containers. In this case, the longer band end 44 with the adhesive application 46 located thereon projects beyond the second clamping jaw 42, which is located at the front with respect to the direction of travel LR, in the direction of travel.

The shorter band ends 44 of the two band portions 58 of the same length are each grasped just by the associated second clamping jaws 38, so that these can place the band ends 44 around the short side 20 of the group 16 of containers and press on the longitudinal sides 40 in order to guide them onto the respective adhesive applications on the longer band ends 44 of the band portions 58 and to be able to press them on there in order to thus form the joining points (cf. FIG. 4D).

The two band portions 58 of the same length are additionally shown in FIG. 4A for clarity in a plan view, the adhesive application 46, which can be formed by hot glue, being visible in each instance at one of the band ends 44. These band portions 58 are inserted into the tool head 32 in the manner shown in FIG. 4A, so that they rest against the respective first and second clamping jaws 38 and 42 and are prepared for the guidance towards the group 16 of containers.

As shown in FIGS. 4A and 4B, the end faces of the first and second clamping jaws 38 and 42 facing the two short sides 20 of the group 16 of containers are each located at the same height and are initially guided synchronously towards the group 16 of containers (FIG. 4B) until a respective central portion of the band portion 58, which is guided and held by the respective first clamping jaws 38, rests against the corresponding short side 20 of the group 16 of containers.

As soon as this is the case, according to FIG. 4B, the first clamping jaws 38 can be moved further towards one another by a small amount in order to apply at least a part of the required deformation forces 18 to the short sides 20 of the group 16 of containers and to thereby deform all containers 14 in the group 16 approximately elliptically, as a result of which the longitudinal sides 40 of the group move slightly away from one another parallel to the direction of travel LR.

Since, when the maximum deformation forces 18 are applied, there is a risk that the containers 14 will move away from one another and leave the rectangular formation, second clamping jaws 42 are expediently moved in the manner shown in FIG. 4C against the longitudinal sides 40 of the group 16 of containers before the first clamping jaws 38 are fully advanced in a direction transverse to the direction of travel LR, by the second clamping jaws being displaced transversely to the direction of travel LR of the group 16 of containers in the direction parallel to the first clamping jaws 38, but by a significantly further distance along the longitudinal sides 40 of the group 16 of containers.

However, this applies only to the second clamping jaws 42, on which the longer band end 44 of the band portion 58, which is simultaneously provided with the adhesive application 46, is held and guided. The shorter band end 44, which has no adhesive application, remains unchanged in its position together with the second clamping jaws 42, which have not yet been displaced transversely to the direction of travel LR and are thus still located at the same height as the first clamping jaws 38. This process phase is illustrated by FIG. 4C.

In this case, the rear second clamping jaw 42 located to the left of the group 16 of containers in the direction of travel LR is displaced to such an extent by an advancing movement 48 that the longer band end 44 guided therewith with the adhesive application 46 is completely applied to the rear longitudinal side 40 of the group 16 of containers in the direction of travel LR. In addition, the front second clamping jaw 42 located to the right of the group 16 of containers in the direction of travel LR is displaced to the same extent by a corresponding advancing movement 48, whereby the longer band end 44 guided therewith with the adhesive application 46 is completely applied to the front longitudinal side 40 of the group 16 of containers in the direction of travel LR.

The mentioned advancing movements of the second clamping jaws 42 are denoted in FIG. 4B and in FIG. 4C in each instance by the reference numeral 48. These advancing movements 48 of a part of the second clamping jaws 42 simultaneously ensure that the longer band end 44 of the respective band portion 58 guided by the second clamping jaws 42 is placed around the group with contact, without the second clamping jaws 42 in this case reaching the adhesive application 46 with the hot glue located at the relevant longer band end 44. This adhesive application 46 with hot glue remains free because the shorter band ends 44 of the band portion 58 are pressed thereon in order to be able to adhesively bond the joining points.

If the second clamping jaws 42 resting against the group 16 of containers at the rear on the left side in the direction of travel LR and the second clamping jaws 42 resting against the group 16 of containers at the front on the right side in the direction of travel LR in the manner shown in FIG. 4C rest against the longitudinal sides 40 of the group 16 of containers, the group is prevented from moving apart so that the maximum deformation forces 18 required for the desired container deformation can now be introduced via the first clamping jaws 38 onto the short sides 20 of the group 16 of containers.

At the same time, in the process phase shown in FIG. 4C, it is expedient to exert defined holding forces 50 from both sides in the direction parallel to the direction of travel LR onto the two longitudinal sides 40 of the group 16 of containers by the second clamping jaws 42 advanced towards and against the longitudinal sides 40, which can serve for the fixed pressing of the longer band end 44 of the respective band portion 58, for the avoidance of folds or loops in the band portion 58, and for the reliable fixing of the containers 14 in the group 16, so that the latter cannot leave the rectangular arrangement.

After the application of the longer band ends 44 shown in FIG. 4C to the longitudinal sides 40 of the group 16 of containers, the adhesive applications 46 located on the band ends 44 comprising hot glue remaining free in each instance and not being reached by the second clamping jaws 42, in the next process step the further second clamping jaws 42, which are located on the right and left side of the group 16 of containers in the direction of travel LR and have not yet been advanced towards the group 16 of containers, are guided towards the longitudinal sides 40 of the group 16 of containers by the advancing movements 48 directed perpendicularly to the direction of travel LR (cf. FIG. 4C) in the manner shown in FIG. 4D by being displaced transversely to the direction of travel LR of the group 16 of containers in a direction parallel to the first clamping jaws 38, but by a slightly further distance along the longitudinal sides 40 of the group 16 of containers.

The mentioned advancing movements of the second clamping jaws 42 located on the left and right side of the group 16 of containers in the direction of travel LR are again denoted by the reference numeral 48 in FIG. 4C. These advancing movements 48 of the second clamping jaws 42 not yet previously advanced simultaneously ensure that the shorter band end 44 of the respective band portions 58 guided by the second clamping jaws 42 is placed around the group with contact, more specifically with overlap of the adhesive application 46 comprising the hot glue located at each band end 44 by the shorter band ends 44 of the respective band portion 58, so that the band ends 44 of the band portions 58 overlapping in this region lie on top of the longer band ends 44 and are adhesively bonded to them by application of the holding forces 50 (cf. FIG. 4D) whilst being pressed on at least slightly.

As mentioned, in the process phase shown in FIG. 4D, it is expedient to exert, by the second clamping jaws 42, defined holding forces 50 from both sides in a direction parallel to the direction of travel LR onto the band portions 58 contacted by the second clamping jaws 42 on both longitudinal sides 40 of the group 16 of containers, which can serve for the fixed pressing of the band ends 44 not coated with hot glue during the adhesive bonding to the band ends 44 provided with hot glue and to reliably fix the containers 14 in the group 16 so that the strapped package 28 can be finished in this way in the desired manner.

The total of two first clamping jaws 38 and the total of four second clamping jaws 42 here, which can each be advanced towards one another in pairs or in a diagonal arrangement, form, in conjunction with the previously performed application of the adhesive applications 46, fixing devices 52 which are to be designated as such, which form part of the tool 30 for producing the strapped packages 28.

Figure 4E:
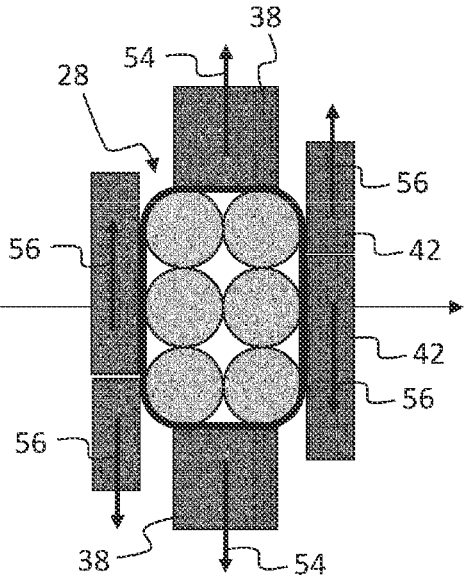

After the curing of the adhesive points at the joining points, i.e., at the regions of the overlapping band ends 44, the two pairs of second clamping jaws 42 and the pair of first clamping jaws 38 can be moved away from the finished strapped package 28 in the directions shown in FIG. 4E, which is indicated by arrows illustrating return movements 54 of the first clamping jaws 38 and return movements 56 of the second clamping jaws 42.

Both the return movements 54 of the first clamping jaws 38 and the return movements 56 of the second clamping jaws 42 oriented parallel thereto are naturally oriented perpendicularly to the direction of travel LR of the group 16 of containers or of the finished strapped package 28 shown in FIG. 4E.

Since, after the removal of the deformation forces 18 and after the removal of the clamping jaws 38 and 42, the containers 14 of the strapped package 28 attempt to return to their original shape, and since the strapping band 26 placed around the group 16 of containers has an overall length after its adhesive bonding that is slightly smaller than an overall circumference of the relaxed containers 14 kept together in the strapped package 28, a defined band tension of the closed strapping band 26 is brought about.

The strapping band 26 used in the strapping method according to FIG. 3A to 3E and according to FIG. 4A to 4E can optionally be manufactured from a suitable pulp material, such as paper or cardboard, or from a composite material. In principle, a plastics band consisting of PET material, for example, is also suitable as the strapping band 26, provided that it can be adhesively bonded in the described way in a mechanically loadable manner.

The schematic plan views of FIG. 5A to 5E lastly show successive method steps of a third method variant when using a tool 30 or a strapping head 32 for producing strapped packages 28 according to FIG. 1E. In this case, the strapping band 26 is not adhesively bonded, but is welded, which is why the strapping band used can typically be a plastics band, for example a band made of PET plastics material.

Figure 5A:
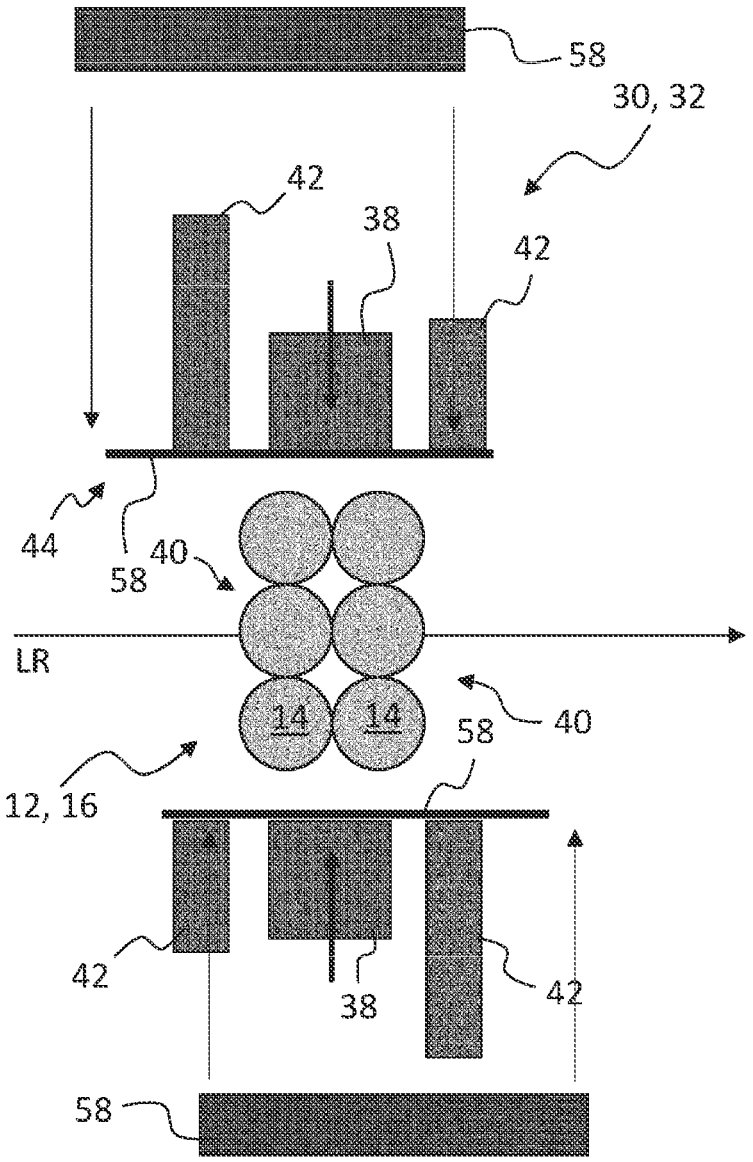
FIG. 5A to 5E show, in total, five schematic plan views of successive process steps of a third method variant of the method according to the invention for producing strapped packages.
Figure 5B:
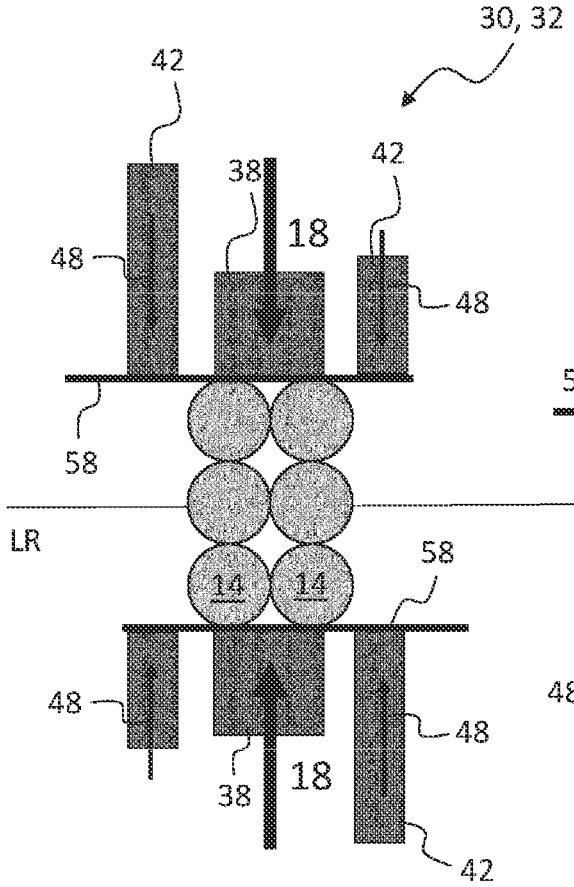
Figure 5C:
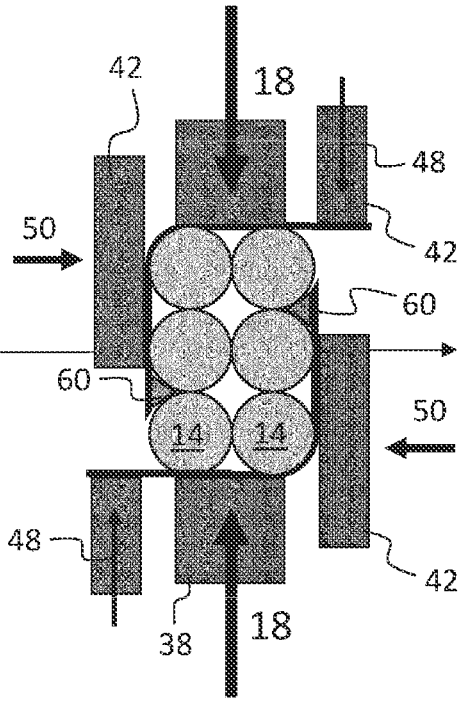

As is clear from the schematic plan views of FIG. 5A to 5C, a group 16 of containers, which is again arranged in a rectangular arrangement and is formed by a total of six cylindrical containers 14 each with deformable or flexible lateral surfaces, is provided and brought into the effective region of a strapping head 32 forming the mentioned tool 30 (FIG. 5A). In this respect, the second method variant explained here does not differ from the previously explained first method variant (cf. FIG. 3A to 3E) or from the above-explained second method variant (cf. FIG. 4A to 4E).

Figure 5D:
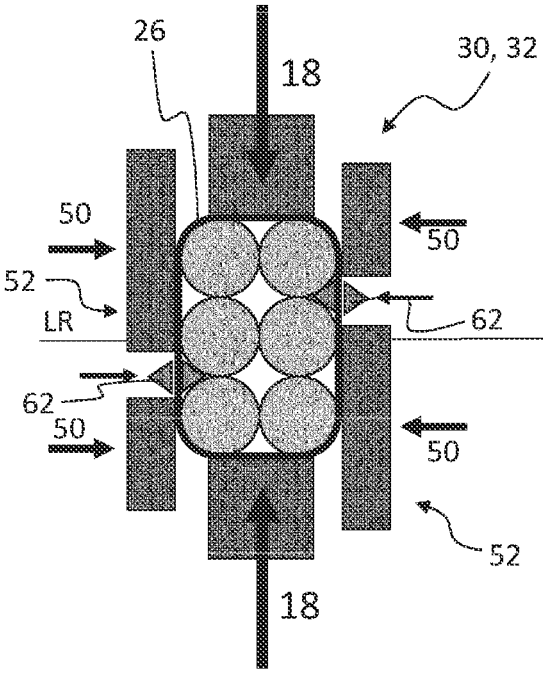

Since the group 16 of containers and/or the strapping tool 30 or the strapping head 32 are optionally moved from the left to the right in the conveying direction or direction of travel LR shown, while the successive process steps are carried out, this direction of travel LR is shown across all of FIG. 5A to 5E as a continuous arrow, the method sequence being intended to continue seamlessly from FIG. 5C to FIG. 5D, even if the arrow is interrupted here for drawing purposes.

According to FIG. 5A, two band portions 58 of uniform or the same length are each applied to first clamping jaws 38 of the strapping head 32 or inserted there in such a way that the band portions 58 are each guided and held by suitable associated contact or holding surfaces (not shown) of the clamping jaws 38 without being able to slip or fall out. The first clamping jaws 38 can each be moved in pairs from both sides towards and against the short sides 20 of the group 16 of containers. These first clamping jaws 38 simultaneously also serve to apply the deformation forces 18 required for the deformation of the containers 14 of the group 16 of containers, as illustrated in FIGS. 5B, 5C and 5D.

In addition, the tool 30 or the strapping head 32 has second clamping jaws 42 which can be advanced towards one another or can be applied against the longitudinal sides 40 of the group 16 of containers and which serve substantially to apply the strapping band 26 located between the first clamping jaws 38 and the short sides 20 of the group 16 of containers against the opposite longitudinal sides 40, but which do not generate any deformation forces or exert such forces on the group 16 of containers.

Since the band portions 58 are of the same length on both sides of the group 16 of containers moving in the direction of travel LR and, in contrast to the previously described method variant, there is no shorter or longer band portions, this is a symmetrical structure on both sides of the group 16 of containers, i.e., on the two short sides 20 thereof. A first band portion 58 is thus held and guided at the first and second clamping jaws 38 and 42 located on the left of the group 16 of containers in the direction of travel LR, the band portion 58 being welded at one of its band ends 44 in a later process step to the overlapping band end 44 of the other band portion 58 (cf. FIG. 5D). This band end 44 welded later projects further beyond the corresponding second clamping jaw 42 than the other band end 44 projects beyond the second clamping jaw 42 located there.

The first and second clamping jaws 38 and 42 described here with the band portion 58 held thereon are shown in FIG. 5A above the group 16 of containers. In this case, the longer band end 44 projects beyond the second clamping jaw 42, which is located at the rear with respect to the direction of travel LR, counter to the direction of travel LR.

The first and second clamping jaws 38 and 42 located on the right short side 20 of the group 16 of containers in the direction of travel LR hold and guide the further band portion 58 of the same length. This band end 44, which will likewise be welded later, again projects further beyond the corresponding second clamping jaw 42 than the other band end 44 projects beyond the second clamping jaw 42 located there.

The first and second clamping jaws 38 and 42 described here with the band portion 58 held thereon are shown in FIG. 5A below the group 16 of containers. In this case, the longer band end 44 projects beyond the second clamping jaw 42, which is located at the front with respect to the direction of travel LR, in the direction of travel LR.

The shorter band ends 44 of the two band portions 58 of the same length are each grasped just by the associated second clamping jaws 38, so that these can place the band ends 44 around the short side 20 of the group 16 of containers and press on the longitudinal sides 40 in order to guide them onto the respective adhesive applications on the longer band ends 44 of the band portions 58 and to be able to press them on there in order to thus form the joining points formed by welded connections (cf. FIG. 5D).

The two band portions 58 of the same length are additionally shown in a plan view in FIG. 5A for clarity. These band portions 58 are inserted into the tool head 32 in the manner shown in FIG. 5A, so that they rest against the respective first and second clamping jaws 38 and 42 and are prepared for the guidance towards the group 16 of containers.

As shown in FIGS. 5A and 5B, the end faces of the first and second clamping jaws 38 and 42 facing the two short sides 20 of the group 16 of containers are each located at the same height and are initially guided synchronously towards the group 16 of containers (FIG. 5B) until a respective central portion of the band portion 58, which is guided and held by the respective first clamping jaws 38, rests against the corresponding short side 20 of the group 16 of containers.

As soon as this is the case, according to FIG. 5B, the first clamping jaws 38 can be moved further towards one another by a small amount in order to apply at least a part of the required deformation forces 18 to the short sides 20 of the group 16 of containers and to thereby deform all containers 14 in the group 16 approximately elliptically, as a result of which the longitudinal sides 40 of the group move slightly away from one another parallel to the direction of travel LR.

Since, when the maximum deformation forces 18 are applied, there is a risk that the containers 14 will move away from one another and leave the rectangular formation, second clamping jaws 42 are expediently moved in the manner shown in FIG. 5C against the longitudinal sides 40 of the group 16 of containers before the first clamping jaws 38 are fully advanced in a direction transverse to the direction of travel LR, by the second clamping jaws being displaced transversely to the direction of travel LR of the group 16 of containers in the direction parallel to the first clamping jaws 38, but by a significantly further distance along the longitudinal sides 40 of the group 16 of containers.

However, this applies only to the second clamping jaws 42, on which the longer band end 44 of the band portion 58 is held and guided. The shorter band end 44 remains unchanged in its position together with the second clamping jaws 42, which have not yet been displaced transversely to the direction of travel LR and are thus still located at the same height as the first clamping jaws 38. This process phase is illustrated by FIG. 5C.

In this case, the rear second clamping jaw 42 located to the left of the group 16 of containers in the direction of travel LR is displaced to such an extent by an advancing movement 48 that the longer band end 44 guided therewith is completely applied to the rear longitudinal side 40 of the group 16 of containers in the direction of travel LR. In addition, the front second clamping jaw 42 located to the right of the group 16 of containers in the direction of travel LR is displaced to the same extent by a corresponding advancing movement 48, whereby the longer band end 44 guided therewith is completely applied to the front longitudinal side 40 of the group 16 of containers in the direction of travel LR.

The mentioned advancing movements of the second clamping jaws 42 are denoted in FIG. 5B in each instance by the reference numeral 48. These advancing movements 48 of a part of the second clamping jaws 42 simultaneously ensure that the longer band end 44 of the respective band portion 58 guided by the second clamping jaws 42 is placed around the group with contact, without the second clamping jaws 42 in this case reaching the region that is to be welded located at the relevant longer band end 44. This region remains free because the shorter band ends 44 of the band portion 58 are pressed thereon in order to be able to weld the joining points.

FIG. 5C illustrates that in these regions of the band ends 44, which are subsequently to be welded (cf. FIG. 5D), an anvil 60 is arranged beneath in each instance, which forms a counter support for the subsequently placed welding unit 62, so that the overlapping band ends 44 can be pressed there against each other during welding.

If the second clamping jaws 42 resting against the group 16 of containers at the rear on the left side in the direction of travel LR and the second clamping jaws 42 resting against the group 16 of containers at the front on the right side in the direction of travel LR in the manner shown in FIG. 5C rest against the longitudinal sides 40 of the group 16 of containers, the group is prevented from moving apart so that the maximum deformation forces 18 required for the desired container deformation can now be introduced via the first clamping jaws 38 onto the short sides 20 of the group 16 of containers.

At the same time, in the process phase shown in FIG. 5C, it is expedient to exert defined holding forces 50 from both sides in the direction parallel to the direction of travel LR onto the two longitudinal sides 40 of the group 16 of containers by the second clamping jaws 42 advanced towards and against the longitudinal sides 40, which can serve for the fixed pressing of the longer band end 44 of the respective band portion 58, for the avoidance of folds or loops in the band portion 58, and for the reliable fixing of the containers 14 in the group 16, so that the latter cannot leave the rectangular arrangement.

After the application of the longer band ends 44 shown in FIG. 5C to the longitudinal sides 40 of the group 16 of containers, the end portions of the band ends 44 to be welded remaining free in each instance and not being reached by the second clamping jaws 42, in the next process step the further second clamping jaws 42, which are located on the right and left side of the group 16 of containers in the direction of travel LR and have not yet been advanced towards the group 16 of containers, are guided towards the longitudinal sides 40 of the group 16 of containers by the advancing movements 48 directed perpendicularly to the direction of travel LR (cf. FIG. 5C) in the manner shown in FIG. 5D by being displaced transversely to the direction of travel LR of the group 16 of containers in a direction parallel to the first clamping jaws 38, but by a slightly further distance along the longitudinal sides 40 of the group 16 of containers.

The mentioned advancing movements of the second clamping jaws 42 located on the left and right side of the group 16 of containers in the direction of travel LR are again denoted by the reference numeral 48 in FIG. 5C. These advancing movements 48 of the second clamping jaws 42 not yet previously advanced simultaneously ensure that the shorter band end 44 of the respective band portions 58 guided by the second clamping jaws 42 is placed around the group with contact, more specifically with overlap of the portion of the longer band end 44 already located there by the shorter band ends 44 of the respective band portion 58, so that the band ends 44 of the band portions 58 overlapping in this region lie on top of the longer band ends 44 and are welded to them by placement of the welding unit 62 and, optionally, additional application of the holding forces 50 (cf. FIG. 5D) whilst being pressed on at least slightly.

As mentioned, in the process phase shown in FIG. 5D, it is expedient to exert, by the second clamping jaws 42, defined holding forces 50 from both sides in a direction parallel to the direction of travel LR onto the band portions 58, contacted by the second clamping jaws 42, on both longitudinal sides 40 of the group 16 of containers, which can serve for the fixed pressing of the band ends 44 to be welded and for reliably fixing the containers 14 in the group 16 so that the strapped package 28 can be finished in this way in the desired manner.

The total of two first clamping jaws 38 and the total of four second clamping jaws 42 described here in cooperation, which can each be advanced towards one another in pairs or in a diagonal arrangement, form, in conjunction with the anvil 60 and the welding unit 62, the fixing devices 52 which are to be designated as such, which are part of the tool 30 for producing the strapped packages 28.

Figure 5E:
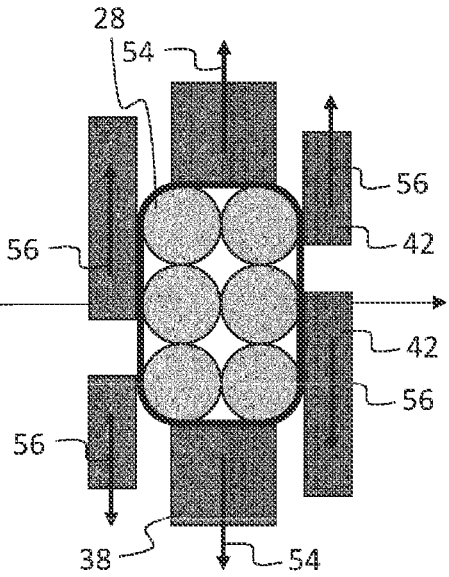

Once the joining points have been finished by welding (cf. FIG. 5D), i.e., at the regions of the overlapping band ends 44, the two pairs of second clamping jaws 42 and the pair of first clamping jaws 38 can be moved away from the finished strapped package 28 in the directions shown in FIG. 5E, which is indicated by arrows illustrating return movements 54 of the first clamping jaws 38 and return movements 56 of the second clamping jaws 42.

Both the return movements 54 of the first clamping jaws 38 and the return movements 56 of the second clamping jaws 42 oriented parallel thereto are naturally oriented perpendicularly to the direction of travel LR of the group 16 of containers or of the finished strapped package 28 shown in FIG. 5E.

Since, after the removal of the deformation forces 18 and after the removal of the clamping jaws 38 and 42, the containers 14 of the strapped package 28 attempt to return to their original shape, and since the strapping band 26 placed around the group 16 of containers has an overall length after its welding that is slightly smaller than an overall circumference of the relaxed containers 14 kept together in the strapped package 28, a defined band tension of the closed strapping band 26 is brought about.

It should be pointed out at this juncture that it may be expedient, for adapting to different container sizes and package configurations with possibly a different number and/or arrangement of articles 10 or containers 14 in the strapped package 28, to make the tool 30 formed by the strapping head 32 adjustable in some of its dimensions and distances of the various clamping jaws 38, 42. For this purpose, the strapping head 32 can have, for example, a frame in which the motor-driven clamping jaws 38 and 42 can be mounted displaceably and variably in their distances from one another.

A motorized drive of the clamping jaws 38 and 42 may mean, for example, a pneumatic, hydraulic or electromotive, possibly also electromagnetic activation and control of the clamping jaws 38 and 42 which are mounted in a linearly movable manner in the context of the strapping head 32.

Figure 6A:
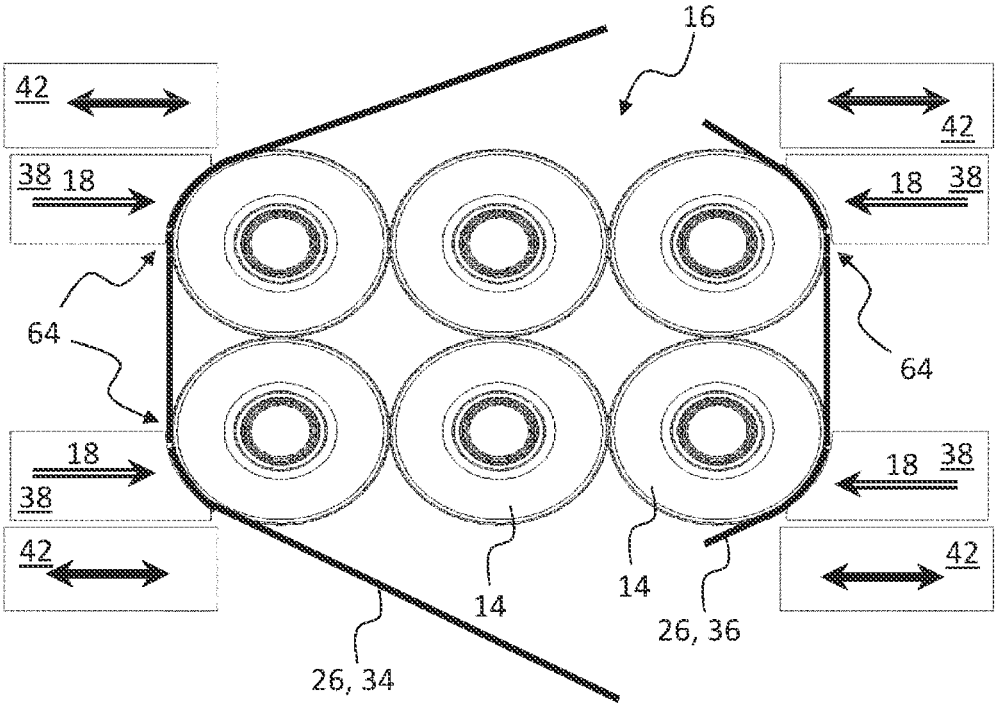

As is illustrated by way of example in the schematic plan view of FIG. 6A, the clamping jaws 38, in particular the first clamping jaws 38, which have to provide for the compression of the containers 14 in the group 16 of containers, can be adapted in their contours to the container lateral surfaces and, for example, can be provided with concave surfaces 64 which are adapted to the container shape in their rounding radii, as a result of which the second clamping jaws 42 can be made significantly smaller as necessary. If the first clamping jaws 38 are provided in pairs with concavely rounded surfaces 64 or contact surfaces and are placed in each instance against both outer corner portions of the group 16 of containers, as is clear in FIG. 6A, the second clamping jaws 42 can ensure, in a smaller embodiment in the manner shown in parallel movement along the longitudinal sides 40 of the group 16 of containers, that the corresponding regions of the band portions 34, 36 and/or 58 that are subsequently to be joined to one another are applied to the group.

In this case, the deformation forces 18 are transmitted to the corner lateral surface portions of the containers 14 located there through the first clamping jaws 38 formed in pairs. Subsequently, the second clamping jaws 42 can be moved in the manner shown, which is illustrated by the advancing movements 48.

By a design of the first clamping jaws 38 according to FIG. 6A, in particular an undesired evasive movement according to FIG. 6B of a lateral surface region of the containers 14 that is not grasped by the clamping jaws 38 can be prevented. By a design of the first clamping jaws 38 according to FIG. 3A to 5E, the contact surfaces of which contact the containers 14 in line contact, an evasive movement of some of the containers 14 can be brought about, which can be the case in particular with very thin-walled and flexible PET containers 14.

In the case of container lateral surfaces 66 which are slightly concavely contoured in the longitudinal direction of the container 14, it can also be expedient to accordingly form the surfaces 64 of the clamping jaws 38 resting against the container lateral surfaces 66 in order to avoid the mentioned undesired effects illustrated in FIG. 6B. Such a design of the clamping jaws 38 contacting the containers 14 is illustrated in the detail view of FIG. 6C.

In this way, the clamping jaws 38 are adapted at least in portions to the contours of the containers 14 which are arranged in the group 16 of containers and are each contacted at their lateral surfaces 66. Since the containers 14 are, in particular, PET beverage containers with flexible lateral surfaces 66, it is expedient to contact these relatively resilient surfaces with correspondingly contoured clamping jaws 38 in order to avoid point or line loads at some locations on the container lateral surfaces 66 formed in particular concavely. In this way, the concave contour of the clamping jaws can, for example, follow the particular outer contour of the container 14 in question, which is convexly curved but widens in the longitudinal direction, and can ensure a gentle deformation during the application of the deformation forces 18.

The following is given as a supplementary note to the above statements. If, in the context of the embodiment variants shown in the figures and their descriptions above, reference is also made often or also generally to "schematic" representations and views, this means by no means that the figure representations and their description are to be of subordinate importance with regard to the disclosure of the invention. The person skilled in the art is certainly able to derive sufficient information from the schematically and abstractly drawn representations that will make it easier for them to understand the invention without being confused in any way by the drawn and possibly not exactly true-to-scale proportions of parts of the tool 30 for producing strapped packages 28, details thereof, or other drawn elements. The figures enable a person skilled in the art as the reader to get a better understanding of the inventive idea-which has been formulated more generally and/or more abstractly in the claims and in the general part of the description-on the basis of the more specifically explained implementations of the method according to the invention and the more specifically explained structure of the tool 30 according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

10 Article
12 Group of articles
14 Container, beverage container, PET beverage container
16 Container grouping
18 Deformation force, pretensioning force
20 Short side
22 Container outline (deformed container)
24 Container outline (undeformed container)
26 Band, strapping band
28 Strapped package, package
30 Tool, tool for producing strapped packages
32 Strapping head
34 Band portion, longer band portion
36 Band portion, shorter band portion
38 First clamping jaws
40 Longitudinal side
42 Second clamping jaws
44 Strap end
46 Adhesive application, hot glue application
48 Advancing movement (second clamping jaws)
50 Holding force (second clamping jaws)
52 Fixing device
54 Return movement (first clamping jaws)
56 Return movement (second clamping jaws)
58 Band portion, band portion of the same length
60 Anvil
62 Welding unit
64 Concavely rounded surface
66 Concave container lateral surface
LR Direction of travel

The invention claimed is:

1. A method for producing strapped packages (28), comprising:

forming a group (12) of at least two articles (10) in a rectangular arrangement, wherein the at least two articles (10) have elastically deformable lateral surfaces, applying deformation forces (18) from at least one side to at least one short side (20) of the group (12) by a first set of clamping jaws (38) that are advanceable towards one another, wherein at least one multi-part strapping band (26) or strapping band (26) open at least at one point is arranged between the first set of clamping jaws (38) and the at least one short side (20) of the article grouping, applying the at least one strapping band (26) to the group (12) of deformed articles, wherein a length of the strapping band (26) corresponds to or is greater than a circumference of the group (12) of deformed articles, wherein, upon removing the deformation forces (18) acting on the group (12) of deformed articles, the article lateral surfaces elastically return to their original shape and bring about a band tensioning of the strapping band (26).

2. The method of claim 1, wherein the deformation forces (18) cause a distancing of the opposite longitudinal sides (40) of the group (12) from one another by an expansion length which is smaller than a compression length of the opposite short sides (20) of the group (12) caused by the deformation forces (18).

3. The method of claim 1, wherein the deformation forces (18) are applied from both sides to the opposite short sides (20) of the group (12).

4. The method of claim 1, wherein the band tensioning of strapping band (26) results in a strapped package (28).

5. The method of claim 4, wherein the strapping band (26) is formed by connecting band ends (44) at an at least one mutually abutting or overlapping contact point to form a closed annular strapping band (26).

6. The method of claim 5, wherein the overlapping band ends (44) are adhesively joined together at the at least one contact point of the strapping band (26).

7. The method of claim 5, wherein the overlapping band ends (44) are welded together.

8. The method of claim 4, wherein the strapping band (26) is formed by a plurality of band portions (34, 36; 58) after the application of the deformation forces (18) by connecting band ends (44) at at least two separate, mutually abutting or overlapping contact points to form a closed annular strapping band (26).

9. The method of claim 8, wherein the overlapping band ends (44) are adhesively joined together at the at least one contact point of the strapping band (26).

10. The method of claim 8, wherein the overlapping band ends (44) are welded together.

11. The method of claim 4, wherein the group (12) of articles comprises at least four identical articles (10) and is deformed along a longitudinal axis of the rectangular arrangement.

12. The method of claim 1, wherein the deformation forces act uniformly on all articles (10) of the group (12).

13. A tool (30) for producing strapped packages (28), each of which is formed by at least two articles (10) which have deformable lateral surfaces, wherein the grouped articles (10) are kept together by at least one strapping band (26), comprising:

a first set of clamping jaws (38) that are advanceable towards one another for applying, from at least one side, deformation forces (18) acting on at least one short side (20) of the group (12) of articles, a second set of clamping jaws (42) that are advanceable towards one another and which are prepared and equipped to apply the strapping band (26) located between the first set of clamping jaws (38) and the short sides (20) of the group (12) of articles to the opposite longitudinal sides (40) of the group (12) of articles, and at least one fixing device (52) for connecting mutually abutting or overlapping band ends (44) or band portions (34, 36; 58) between the first and second sets of clamping jaws (38, 42) in each case bearing against the short sides (20) and against the longitudinal sides (40) in order to fix the strapping band (26), wherein an overall length of a strapping band (26) corresponds to or is greater than an overall circumference of the group (12) of articles which is subjected to the deformation forces (18), wherein a band tension of the strapping band (26) is defined by an elastic recovery of the articles (10) of the group (12) after removal of the deformation forces (18).

14. The tool of claim 13, wherein the at least one fixing device (52) adhesively bonds overlapping band ends (44) of the strapping band (26).

15. The tool of claim 13, wherein the fixing device (52) welds overlapping band ends (44) of the strapping band (26).

16. The tool of claim 13, wherein at least the first set of clamping jaws (38) is partially adapted to contours of the articles (10) arranged in the group (12) and each article is contacted at its lateral surfaces.

17. The tool of claim 13, wherein the second set of clamping jaws (42) hold or fix the articles (10) in the group (12) at the side during the application of the strapping band (26).

18. The tool of claim 17, wherein the second set of clamping jaws (42) apply the strapping band (26) to the group (12) or join er the band portions (34, 36; 58) forming the strapping band (26) to one another at the band ends (44).

19. The tool of claim 18, wherein the second set of clamping jaws (42) can apply the strapping band (26) to the at least one fixing device (52).

* * * * *